US007713033B2

(12) United States Patent
Roach

(10) Patent No.: US 7,713,033 B2
(45) Date of Patent: May 11, 2010

(54) DOUBLE-ACTING, DUPLEX PUMP CONTROLLED BY TWO, TWO POSITION SPOOL VALVES

(75) Inventor: James D. Roach, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 1001 days.

(21) Appl. No.: 10/985,308

(22) Filed: Nov. 10, 2004

(65) Prior Publication Data

US 2006/0099087 A1 May 11, 2006

(51) Int. Cl.
*F04B 35/00* (2006.01)
*F04B 49/00* (2006.01)
*F16K 11/07* (2006.01)

(52) U.S. Cl. ..... 417/346; 417/216; 417/397; 417/534; 417/535; 137/625.66; 91/281

(58) Field of Classification Search ..... 91/218; 137/625.66; 417/212, 213, 216, 397, 534, 417/535, 346
See application file for complete search history.

(56) References Cited

U.S. PATENT DOCUMENTS 3,135,210 A * 6/1964 English ..... 417/347
3,363,575 A * 1/1968 Potts ..... 417/344
3,386,384 A * 6/1968 Potts ..... 417/342
3,711,224 A * 1/1973 Maudlin ..... 417/344
3,815,472 A * 6/1974 Schantz ..... 91/189 R
4,440,404 A 4/1984 Roach et al.
5,061,160 A 10/1991 Kinder et al.
5,337,561 A 8/1994 Raghavan et al.
5,484,269 A 1/1996 Vick
5,984,642 A 11/1999 Danielsson
6,210,131 B1 4/2001 Whitehead
6,263,751 B1 * 7/2001 Arimoto ..... 74/335
6,558,134 B2 5/2003 Serafin et al.
6,585,004 B1 7/2003 Porter
6,651,910 B2 11/2003 Elliott-Moore

* cited by examiner

*Primary Examiner*—Devon C Kramer
*Assistant Examiner*—Leonard J Weinstein
(74) *Attorney, Agent, or Firm*—John W. Wustenberg; Baker Botts, LLP

(57) ABSTRACT

The present invention provides a fluid control system and associated methods. The fluid control system includes a source of a pressurized fluid and a first spool valve having at least two positions, wherein the first spool valve is connected in fluid communication with the source of the pressurized fluid. The fluid control system further includes a second spool valve having at least two positions, wherein the second spool valve is connected in fluid communication with the first spool valve and the source of the pressurized fluid. When the first spool valve is in a first position and the second spool valve is in a second position, a first portion of the pressurized fluid is directed from the source of the pressurized fluid to the second spool valve via the first spool valve.

87 Claims, 9 Drawing Sheets

DOUBLE-ACTING, DUPLEX PUMP CONTROLLED BY TWO, TWO POSITION SPOOL VALVES

BACKGROUND

The present invention relates to pumps and control systems therefore. More particularly, the present invention relates to a double-acting, duplex pump having a power side controlled by two, two position spool valves.

Pumps are used in a wide variety of industries to deliver fluids. For instance, the delivery of fluids at high pressure may be accomplished with an intensifier pump. Intensifier pumps are commonly used in a variety of industries where the delivery of fluids at a high pressure is desired. For example, intensifier pumps may be used in conjunction with subterranean operations to deliver cement slurries, stimulation fluids, drilling fluids, or other fluids at the desired pressure. Also, in offshore operations, an intensifier pump may be used to remove the hydrostatic head from seawater that is applied to the downhole fluids. In these instances, the intensifier pump may be located subsurface.

Generally, intensifier pumps are reciprocating, fluid-driven apparatuses that comprise one or more large pistons connected to one or more small pistons. Intensifiers are powered by a hydraulic fluid, such as water. In a common intensifier pump, a double-acting, low-pressure, power chamber contains a central piston slidably disposed therein having a high-pressure piston extending from each face. The high pressure pistons extend oppositely from the central piston out of the power chamber into a high-pressure, pumping cylinder. In operation, hydraulic fluid is directed into the low-pressure, power chamber in such a manner to cause the central piston to reciprocate back and forth. The central piston, in turn, drives the high-pressure pistons, which alternately pump an intensified fluid at high pressures to a desired location. As will be understood by those skilled in the art, intensification of the fluid occurs, because the area of the central piston is larger than the area of the high-pressure pistons.

When the central piston reaches one end of its stroke, there may be a short delay in the flow of high-pressure fluid. This delay is due to a necessary precompression of the fluid in the high-pressure, pumping cylinder to the operating pressure. Due to this short delay, there may be a pressure dip in the output from the high-pressure, pumping cylinder. This pressure dip is undesirable, inter alia, because it may damage the power system, the pump, the fluid flow lines, and/or the well. To counteract these pressure dips, a double-acting, duplex intensifier pump may be used, wherein two central pistons may be operated in parallel so that one central piston is on its power stroke while the other central piston is changing direction and/or is in a precompression stroke. The operation of the double-acting, duplex intensifier pump must be controlled with precision because the pressure dip may be severe if both central pistons reach the end of their power strokes simultaneously. Therefore, the timing of the power stroke and precompression stroke of the two central pistons should be controlled to provide a substantially constant discharge pressure from the high-pressure, pumping cylinders. One or more control valves may be provided to control the supply of hydraulic fluid to and venting of hydraulic fluid from the low-pressure, power chambers that contain the two central pistons. Conventional control systems may be hydraulically activated. However, timing issues may occur with the hydraulically activated system, thereby disrupting the compression and precompression cycles of the pump. Problems also may be encountered with control systems for pumps other than intensifier pumps.

SUMMARY

The present invention relates to pumps and control systems therefore. More particularly, the present invention relates to a double-acting, duplex pump having a power side controlled by two, two position spool valves.

One embodiment of the present invention provides a fluid control system that includes a source of a pressurized fluid. The fluid control system further includes a first spool valve having at least two positions, wherein the first spool valve is connected in fluid communication with the source of the pressurized fluid. The fluid control system further includes a second spool valve having at least two positions, wherein the second spool valve is connected in fluid communication with the first spool valve and the source of the pressurized fluid. In one aspect, when the first spool valve is in a first position and the second spool valve is in a second position, a first portion of the pressurized fluid is directed from the source of the pressurized fluid to the second spool valve via the first spool valve. In another aspect, when the first spool valve is in the first position and the second spool valve is in a first position, a third portion of the pressurized fluid is directed from the source of the pressurized fluid to the first spool valve via the second spool valve. In another aspect, when the first spool valve is in a second position and the second spool valve is in the first position, a fifth portion of the pressurized fluid is directed from the source of the pressurized fluid to the first spool valve via the second spool valve. In yet another aspect, when the first spool valve is in the second position and the second spool valve is in the second position, a seventh portion of the pressurized fluid is directed from the source of the pressurized fluid to the first spool valve via the second spool valve.

Another embodiment of the present invention provides a pump system that includes a first double-acting pump that includes a power chamber. The pump system further includes a fluid control system. The fluid control system includes a first spool valve connected in fluid communication to the power chamber of the first double-acting pump. The fluid control system further includes a second spool valve connected in fluid communication to the first spool valve. The pump system further includes a second double-acting pump that includes a power chamber. The power chamber of the second double-acting pump is connected in fluid communication to the second spool valve. Furthermore, the fluid control system directs delivery of a pressurized fluid to the first double-acting pump and the second double-acting pump.

Another embodiment of the present invention provides a method of controlling a pump. The method includes providing a first double-acting pump that includes a power chamber and a piston assembly slidably disposed within the power chamber. The method further includes providing a second double-acting pump that includes a power chamber and a piston assembly slidably disposed within the power chamber. The method further includes positioning a first spool valve in a first position, the first spool valve having at least two positions. The method further includes positioning a second spool valve in a second position, the second spool valve having at least two positions. The method further includes directing a first portion of a pressurized power fluid from a source of the pressurized power fluid to the second spool valve via the first spool valve. And the method further includes directing the first portion of the pressurized power fluid directed to the second spool valve to the power chamber of the second double-acting pump.

Another embodiment of the present invention further provides a method of controlling a pump. The method includes providing a double-acting, duplex pump. The double-acting, duplex pump includes a first double-acting pump that includes a power chamber and a piston assembly slidably disposed within the power chamber. The double-acting, duplex pump further includes a second double-acting pump operably connected to the first double-acting pump. The second double-acting pump includes a power chamber and a piston assembly slidably disposed within the power chamber. The method further includes providing a fluid control system. The fluid control system includes a first spool valve having at least two positions, and a second spool valve having at least two positions. And the method further includes directing a pressurized power fluid to the double-acting duplex pump via the fluid control system.

The features and advantages of the present invention will be readily apparent to those skilled in the art upon a reading of the description of the certain embodiments that follows.

BRIEF DESCRIPTION OF THE DRAWINGS

A more complete understanding of the present disclosure and advantages thereof may be acquired by referring to the following description taken in conjunction with the accompanying drawings, wherein.

Figure 1:
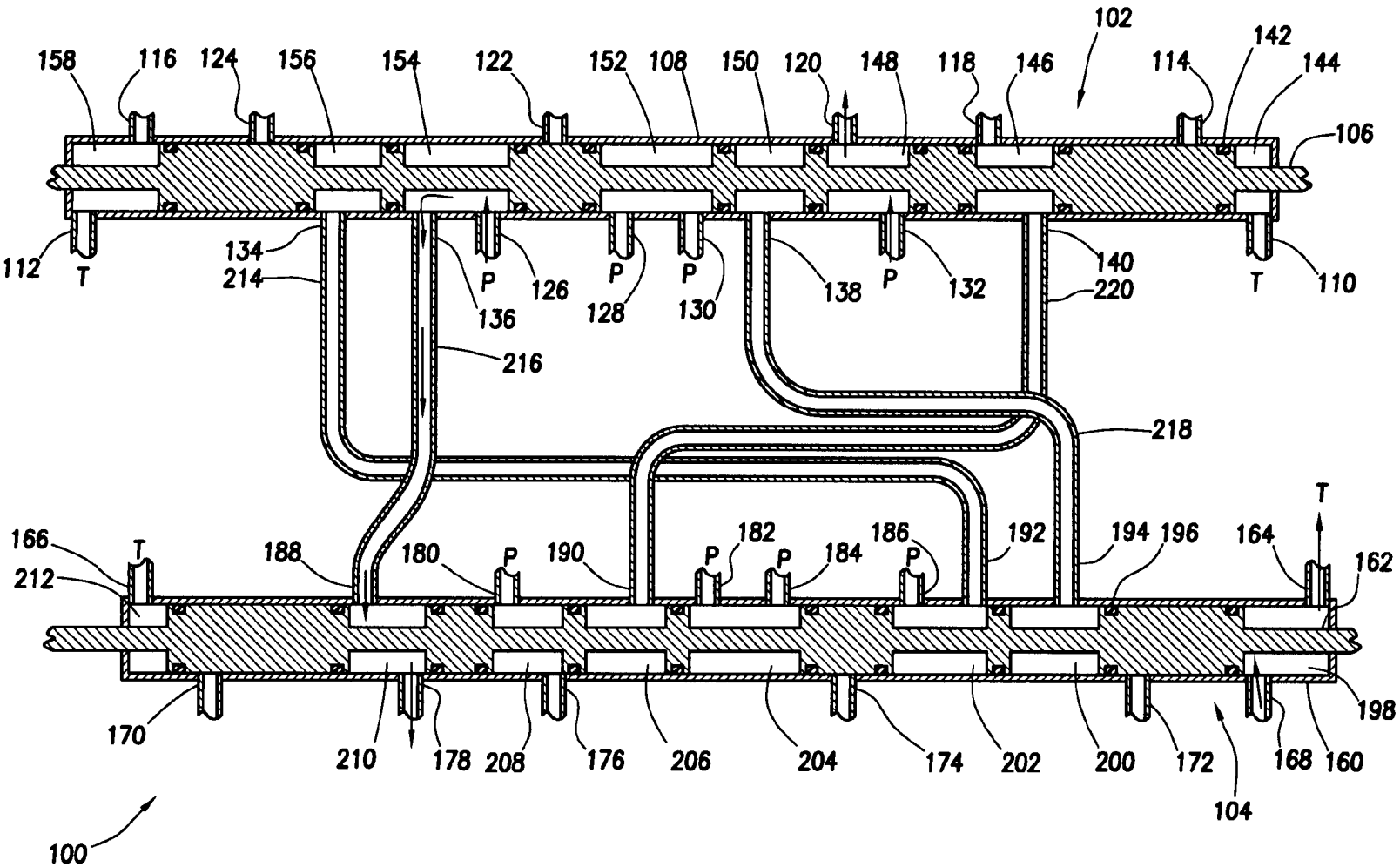
FIG. 1 is a schematic diagram of a fluid control system of the present invention with the first spool valve in a first position and the second spool valve in a second position in accordance with an embodiment of the present invention.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION

The present invention relates to pumps and control systems therefore. More particularly, the present invention relates to a double-acting, duplex pump having a power side controlled by two, two position spool valves.

Referring now to FIG. 1 through FIG. 4, a fluid control system of the present invention is shown generally by reference numeral 100. The fluid control system includes first spool valve 102 and second spool valve 104. First spool valve 102 and second spool valve 104 are both two-position spool valves, wherein each spool valve has a first position and a second position. First spool valve 102 is shown in its first position in FIG. 1 and FIG. 2 and in its second position in FIG. 3 and FIG. 4. Second spool valve 104 is shown in its first position in FIG. 2 and FIG. 3 and in its second position in FIG. 1 and FIG. 4. Shifting of the spool valves between their first position and their second position may be accomplished by a variety of shifting mechanisms, a first shifting mechanism 580 and a second shifting mechanism 582 is shown connected to first spool valve 102 and second spool valve 104, respectively, in FIG. 5. For example, the spool valves may be shifted mechanically, hydraulically, electrically, or by any other suitable shifting mechanism. Where shifting is accomplished mechanically, no outside power source is needed to operate fluid control system 100. Those of ordinary skill in the art should be able to select and implement the appropriate mechanism to shift the spool valves between their two positions.

Referring again to FIG. 1 through FIG. 4, first spool valve 102 includes sleeve/body 108 and central spool 106 slidably disposed within sleeve/body 108. Sleeve/body 108 includes two fluid return ports 110, 112 that can be connected to a power fluid return T. Sleeve/body 108 includes two fluid exhaust inlet ports 114, 116 that can be connected to a source of an exhaust fluid, e.g., the discharge from the power chamber of an intensifier pump. Sleeve/body 108 includes four fluid supply ports 118, 120, 122, 124 that can be connected to the inlet to the power chamber of an intensifier pump. Sleeve/body 108 includes four load ports 126, 128, 130, 132 adapted to be connected to a load P, e.g., a source of a pressurized fluid. The power fluid return T should be at a lower pressure than the load P, e.g., the source of the pressurized fluid. Sleeve/body 108 includes four connector ports 134, 136, 138, 140 that can be connected to second spool valve 104.

Central spool 106 optionally includes a plurality of seals 142, for example, O-rings, for providing sealing engagement between central spool 106 and sleeve/body 108. In some embodiments, a close clearance between central spool 106 and sleeve/body 108 may provide for sealing. Central spool 106 has a first grooved portion 144 for connecting fluid return port 110 and fluid exhaust inlet 114 in fluid communication with each other. Central spool 106 has a second grooved portion 146 for connecting fluid supply port 118 and connector port 140 in fluid communication with each other. Central spool 106 has a third grooved portion 148 for connecting fluid supply port 120 and load port 132 in fluid communication with each other. Central spool 106 has a fourth grooved portion 150 for connecting load port 130 and connector port 138 in fluid communication with each other. Central spool 106 has a fifth grooved portion 152 for connecting fluid supply port 122 and load port 128 in fluid communication with each other. Central spool 106 has a sixth grooved portion 154 for connecting load port 126 and connector port 136 in fluid communication with each other. Central spool 106 has a seventh grooved portion 156 for connecting fluid supply port 124 and connector port 134 in fluid communication with each other. Central spool 106 has an eighth grooved portion 158 for connecting fluid return port 112 and fluid exhaust inlet 116 in fluid communication with each other.

Figure 2:
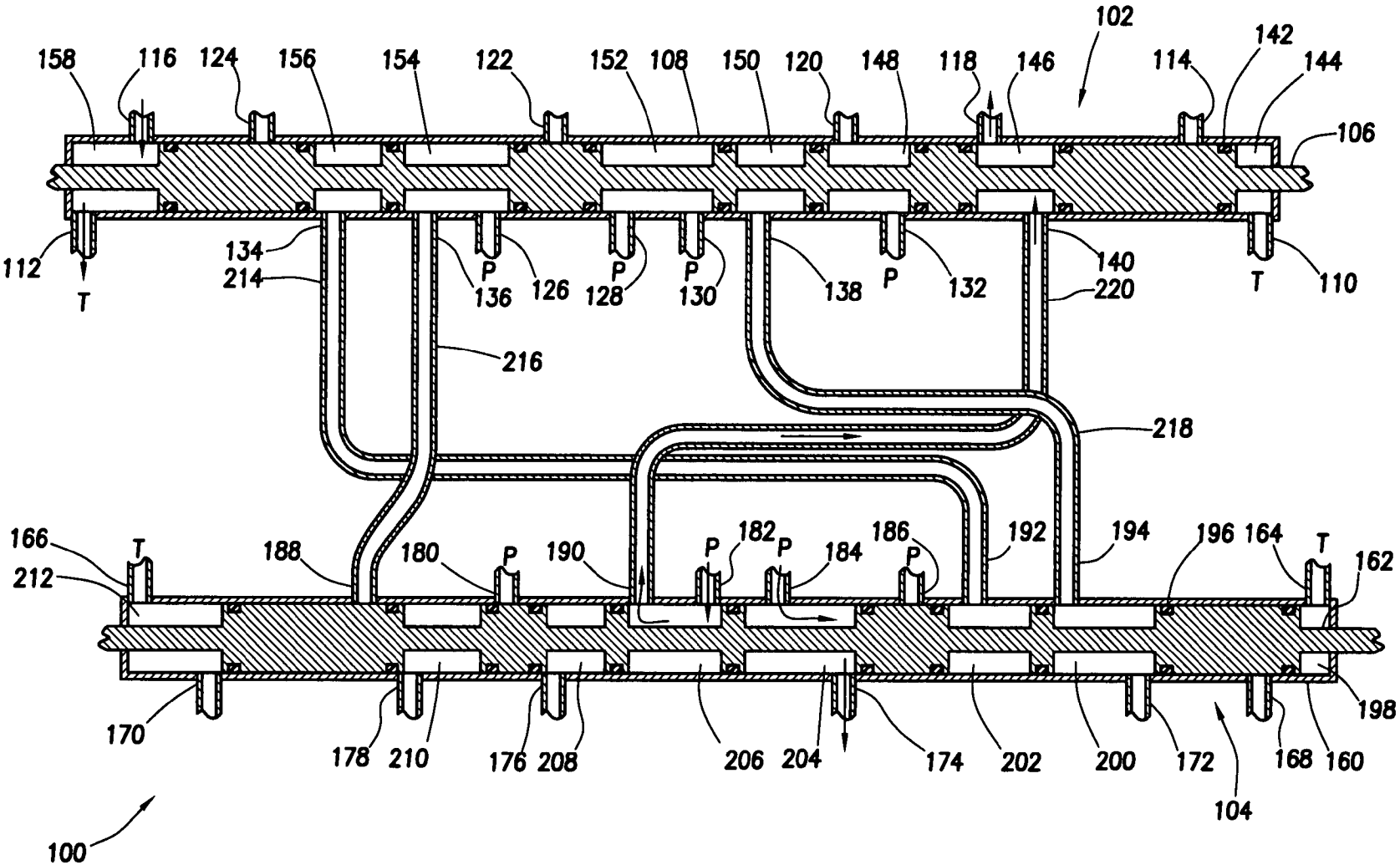
FIG. 2 is a schematic diagram of a fluid control system of the present invention with the first spool valve in a first position and the second spool valve in a first position in accordance with an embodiment of the present invention.

As illustrated by FIG. 1 and FIG. 2, in the first position of first spool valve 102, fluid supply port 118 and connector port 140 are connected in fluid communication, fluid supply port 120 and load port 132 are connected in fluid communication, load port 126 and connector port 136 are connected in fluid communication, and fluid exhaust inlet 116 and fluid return port 112 are connected in fluid communication.

Figure 3:
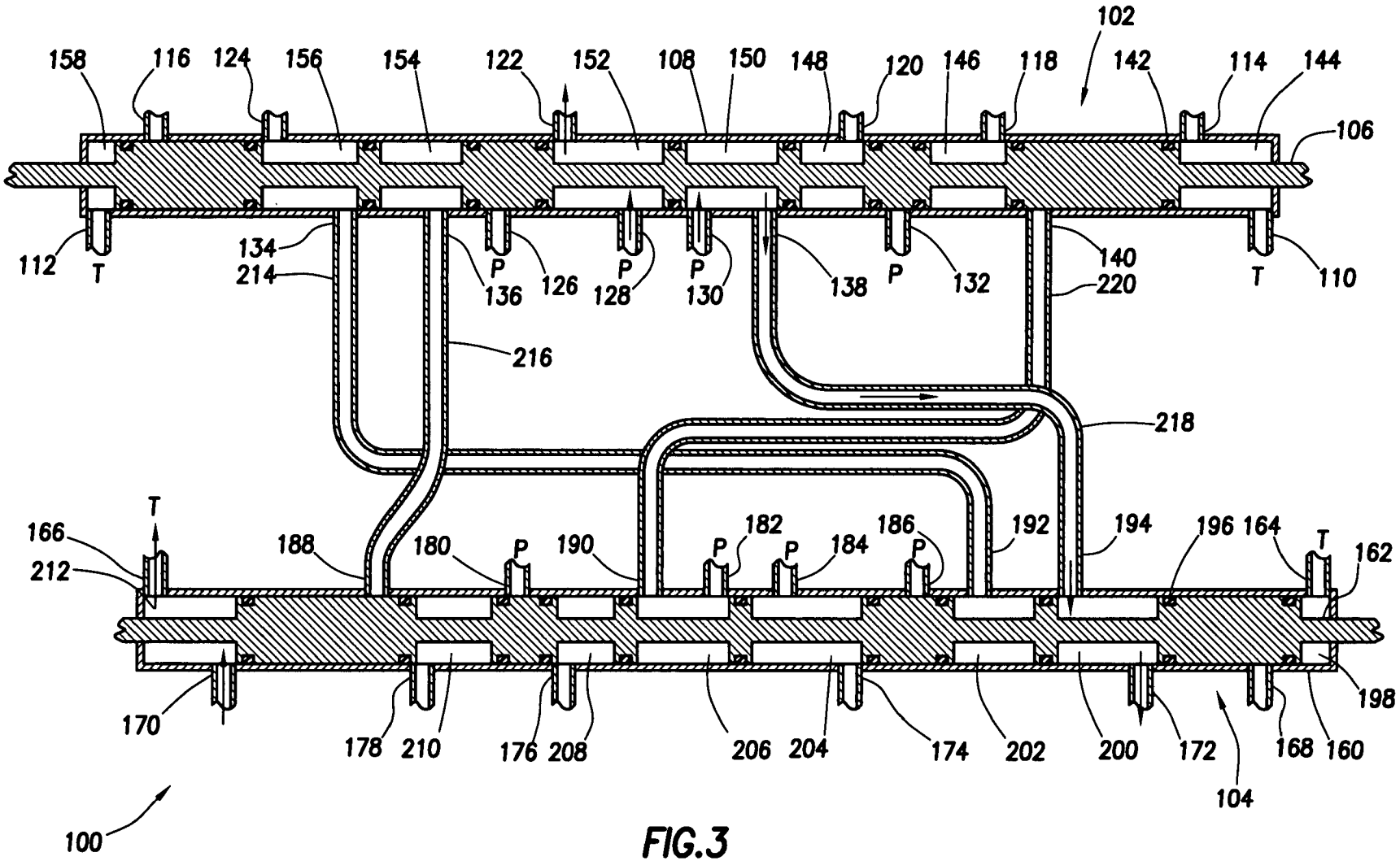
FIG. 3 is a schematic diagram of a fluid control system of the present invention with the first spool valve in a second position and the second spool valve in a first position in accordance with an embodiment of the present invention.
Figure 4:
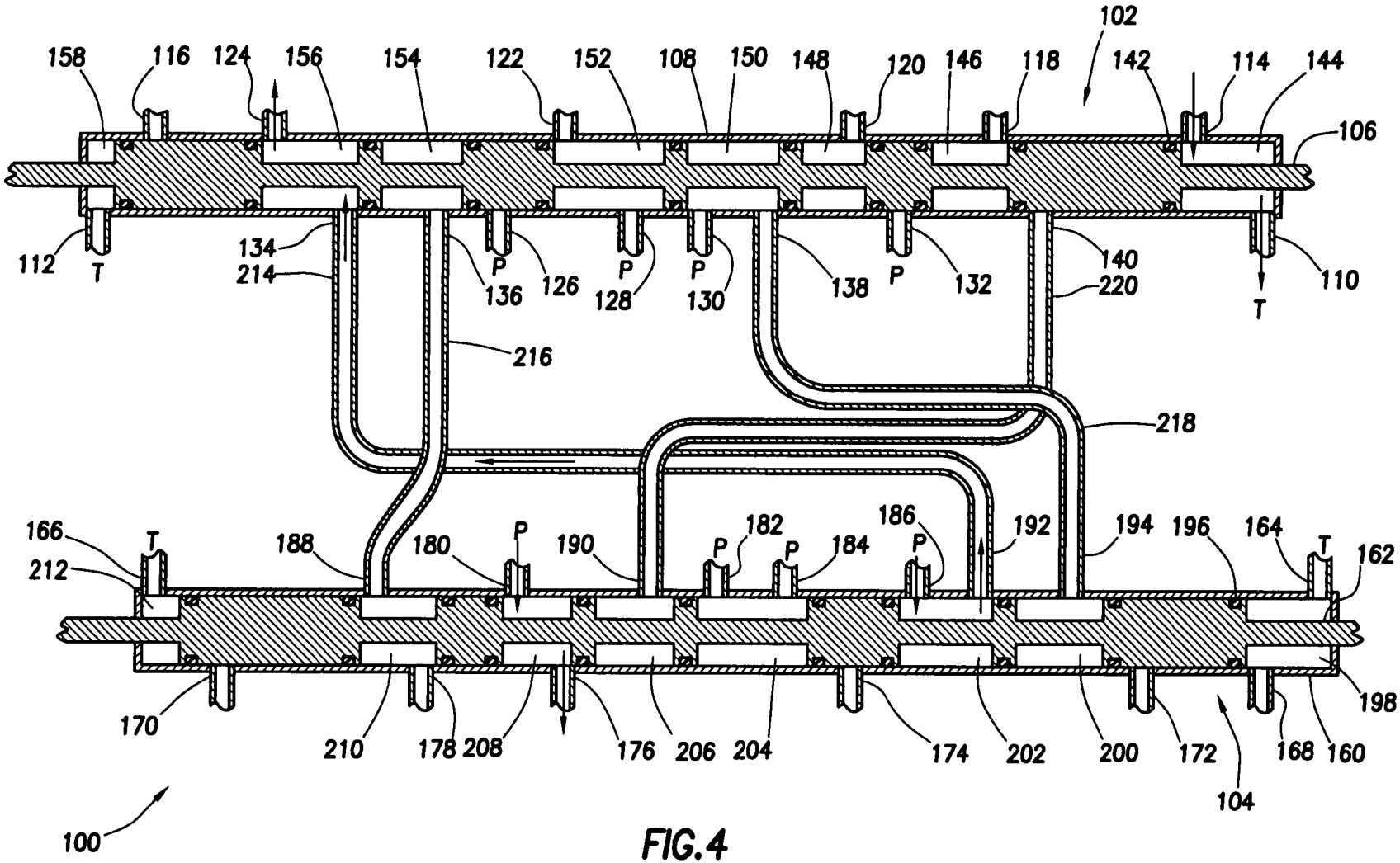
FIG. 4 is a schematic diagram of a fluid control system of the present invention with the first spool valve in a second position and the second spool valve in a second position in accordance with an embodiment of the present invention.

As illustrated by FIG. 3 and FIG. 4, in the second position of first spool valve 102, fluid return port 110 and fluid exhaust inlet 114 are connected in fluid communication, load port 130 and connector port 138 are connected in fluid communication, and fluid supply port 124 and connector port 134 are connected in fluid communication.

Second spool valve 104 includes sleeve/body 160 and central spool 162 slidably disposed within sleeve/body 160. Sleeve/body 160 includes two fluid return ports 164, 166 that can be connected to a power fluid return T. Sleeve/body 160 includes two fluid exhaust inlets 168, 170 that can be connected to the discharge from the power chamber of an intensifier pump. Sleeve/body 160 includes four fluid supply ports 172, 174, 176, 178 that can be connected to the inlet to the power chamber of an intensifier pump. Sleeve/body 160 includes four load ports 180, 182, 184, 186 adapted to be connected to a load P, e.g., a source of pressurized fluid. Sleeve/body 160 includes four connector ports 188, 190, 192, 194 that can be connected to first spool valve 104.

Central spool 162 optionally includes a plurality of seals 196, for example, O-rings, for providing sealing engagement between central spool 162 and sleeve/body 160. In some embodiments, a close clearance between central spool 162 and sleeve/body 160 may provide for sealing. Central spool 162 has a first grooved portion 198 for connecting fluid return port 164 and fluid exhaust inlet 168 in fluid communication with each other. Central spool 162 has a second grooved portion 200 for connecting fluid supply port 172 and connector port 194 in fluid communication with each other. Central spool 162 has a third grooved portion 202 for connecting connector port 192 and load port 186 in fluid communication with each other. Central spool 186 has a fourth grooved portion 204 for connecting load port 184 and fluid supply port 174 in fluid communication with each other. Central spool 162 has a fifth grooved portion 206 for connecting connector port 190 and load port 182 in fluid communication with each other. Central spool 162 has a sixth grooved portion 208 for connecting load port 180 and fluid supply port 176 in fluid communication with each other. Central spool 162 has a seventh grooved portion 210 for connecting fluid supply port 178 and connector port 188 in fluid communication with each other. Central spool 162 has an eighth grooved portion 212 for connecting fluid return port 166 and fluid exhaust inlet 170 in fluid communication with each other.

As illustrated by FIG. 2 and FIG. 3, in the first position of second spool valve 104, fluid supply port 172 and connector port 194 are connected in fluid communication, load port 184 and fluid supply port 174 are connected in fluid communication, load port 182 and connector port 190 are connected in fluid communication, and fluid return port 166 and fluid exhaust inlet 170 are connected in fluid communication.

As illustrated by FIG. 1 and FIG. 4, in the second position of second spool valve 104, fluid return port 164 and fluid exhaust inlet 168 are connected in fluid communication, connector port 192 and load port 186 are connected in fluid communication, load port 180 and fluid supply port 176 are connected in fluid communication, and connector port 188 and fluid supply port 178 are connected in fluid communication.

First spool valve 102 and second spool valve 104 are shown connected by four fluid flow lines. These four fluid flow lines are used to direct power fluid between the two spool valves. Connector port 134 of first spool valve 102 and connector port 192 of second spool valve 104 are connected via fluid flow line 214. Connector port 136 of first spool valve 102 and connector port 188 of second spool valve 104 are connected via fluid flow line 216. Connector port 138 of first spool valve 102 and connector port 194 of second spool valve 104 are connected via fluid flow line 218. Connector port 140 of first spool valve 102 and connector port 190 of second spool valve 104 are connected via fluid flow line 220. In some embodiments, first spool valve 102 and second spool valve 104 are separate units, wherein the fluid flow lines that connect them to each other would be pipes are hoses that extend between the associated spool valves. In another embodiment, first spool valve 102 and second spool valve 104 may be connected by a manifold. In these embodiments, the fluid flow lines would be passages in the manifold extending between the two spool valves.

As those of ordinary skill in the art will appreciate, because first spool valve 102 and second spool valve 104 are two-position spool valves, fluid control system 100 has four positions. As illustrated by FIG. 1, first spool valve 102 may be in its first position when second spool valve 104 is in its second position. In this position, load port 126 of first spool valve 102 is in fluid communication with fluid supply port 178 of second spool valve 104 via connector port 136 of first spool valve 102, fluid flow line 216, and connector port 188 of second spool valve 104. In operation, when first spool valve 102 is in the first position and second spool valve 104 is in the second position, a first portion of the pressurized fluid is directed from load L (e.g., a source of a pressurized fluid) to second spool valve 104 via first spool valve 102. A second portion of the pressurized fluid is also directed from load L, to a power chamber or cylinder of a first pump, such as power chamber or cylinder 508 of first double-acting pump 502 as shown on FIG. 6, via first spool valve 102. Additionally, a first exhaust fluid is directed from a source of a first exhaust fluid, such as power chamber or cylinder 508 of first double-acting pump 502 as shown on FIG. 6, to power fluid return T via first spool valve 102. Furthermore, a second exhaust fluid is directed from a source of the second exhaust fluid, such as power chamber or cylinder 536 of second double-acting pump 504 as shown on FIG. 6, to power fluid return T via second spool valve 104. Double-acting pumps 502 and 504 and power chambers or cylinders 508 and 536 will be described in more detail below.

As illustrated by FIG. 2, first spool valve 102 may be in its first position when second spool valve 104 is in its first position. In this position, load port 182 of second spool valve 104 is in fluid communication with fluid supply port 118 of first spool valve 102 via connector port 190 of second spool valve 104, fluid flow line 220, and connector port 140 of first spool valve 102. In operation, when first spool valve 102 is in the first position and second spool valve 104 is in the first position, a third portion of the pressurized fluid is directed from load L (e.g., a source of a pressurized fluid) to first spool valve 102 via second spool valve 104. A fourth portion of the pressurized fluid is also directed from load L, to a power chamber or cylinder of a second pump, such as power chamber or cylinder 536 of second double-acting pump 504 as shown on FIG. 7, via first second valve 102. Additionally, a second exhaust fluid is directed from a source of the second exhaust fluid, such as power chamber or cylinder 536 of second double-acting pump 504 as shown on FIG. 7, to power fluid return T via second spool valve 104. Furthermore, a first exhaust fluid is directed from a source of the first exhaust fluid, such as power chamber or cylinder 508 of first double-acting pump 502 as shown on FIG. 7, to power fluid return T via first spool valve 102. Double-acting pumps 502 and 504 and power chambers or cylinders 508 and 536 will be described in more detail below.

As illustrated by FIG. 3, first spool valve 102 may be in its second position when second spool valve 104 is in its first position. In this position, load port 130 of first spool valve 102 is in fluid communication with fluid supply port 172 of second spool valve 104 via connector port 138 of first spool valve 102, fluid flow line 218, and connector port 194 of second spool valve 104. In operation, when first spool valve 102 is in the second position and second spool valve 104 is in the first position, a fifth portion of the pressurized fluid is directed from load L (e.g., a source of a pressurized fluid) to second spool valve 104 via first spool valve 102. A sixth portion of the pressurized fluid is also directed from load L, to a power chamber or cylinder of a first pump, such as power chamber or cylinder 508 of first double-acting pump 502 as shown on FIG. 8, via first spool valve 102. Additionally, a first exhaust fluid is directed from a source of a first exhaust fluid, such as power chamber or cylinder 508 of first double-acting pump 502 as shown on FIG. 8, to power fluid return T via first spool valve 102. Furthermore, a second exhaust fluid is directed from a source of the second exhaust fluid, such as power chamber or cylinder 536 of second double-acting pump 504 as shown on FIG. 8, to power fluid return T via second spool valve 104. Double-acting pumps 502 and 504 and power chambers or cylinders 508 and 536 will be described in more detail below.

As illustrated by FIG. 4, first spool valve 102 may be in its second position when second spool valve 104 is in its second position. In this position, load port 186 of second spool valve 104 is in fluid communication with fluid supply port 124 of first spool valve 102 via connector port 192 of second spool valve 104, fluid flow line 214, and connector port 134 of first spool valve 102. In operation, when first spool valve 102 is in the second position and second spool valve 104 is in the second position, a seventh portion of the pressurized fluid is directed from load L (e.g., a source of a pressurized fluid) to first spool valve 102 via second spool valve 104. An eighth portion of the pressurized fluid is also directed from load L, to a power chamber or cylinder of a second pump, such as power chamber or cylinder 536 of second double-acting pump 504 as shown on FIG. 9, via first second valve 102. Additionally, a second exhaust fluid is directed from a source of the second exhaust fluid, such as power chamber or cylinder 536 of second double-acting pump 504 as shown on FIG. 9, to power fluid return T via second spool valve 104. Furthermore, a first exhaust fluid is directed from a source of the first exhaust fluid, such as power chamber or cylinder 508 of first double-acting pump 502 as shown on FIG. 9, to power fluid return T via first spool valve 102. Double-acting pumps 502 and 504 and power chambers or cylinders 508 and 536 will be described in more detail below.

Figure 5:
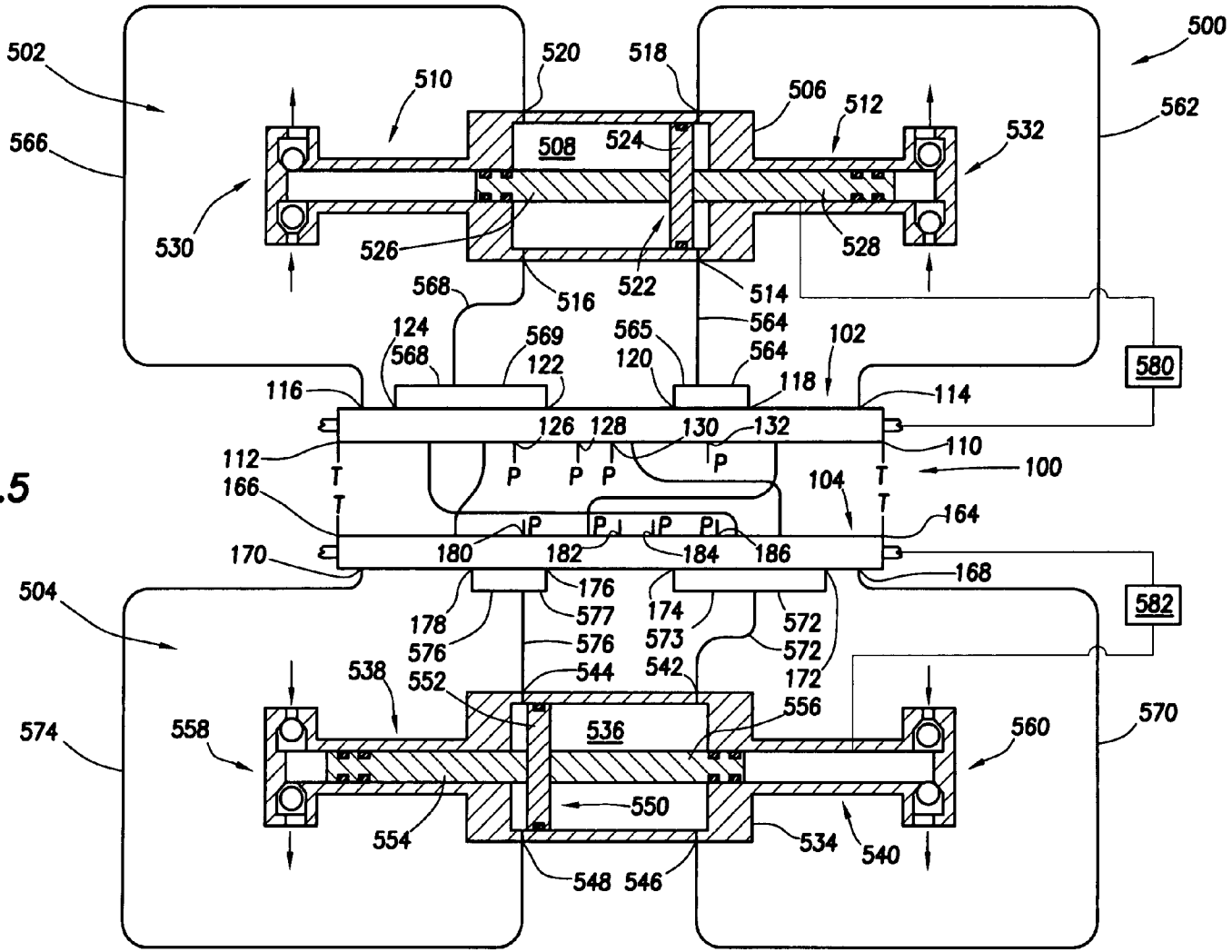
FIG. 5 is a schematic diagram illustrating the flow control system of the present invention connected to double-acting, duplex pump in accordance with an embodiment of the present invention.

Referring now to FIG. 5 is shown fluid control system 100 that directs the power fluid from a load P, e.g., a source of pressurized power fluid (not shown), to double-acting, duplex pump 500. Double-acting, duplex pump 500 includes first double-acting pump 502 and second double-acting pump 504. Fluid control system 100 allows one end of first double-acting pump 502 to be on its power stroke while one end of second double-acting pump 502 is on its precompression stroke. Furthermore, fluid control system 100 allows one end of second double-acting pump 504 to be on its power stroke while one end of first double-acting pump 502 is on its precompression stroke. Any of a variety of suitable pumps may be used as first double-acting pump 502 and second double-acting pump 504. For example, the first double-acting pump 502 and second double-action pump 504, as shown, in FIG. 5 are intensifier pumps.

Generally, first double-acting pump 502 includes housing 506 that defines power chamber or cylinder 508 and a pair of pumping cylinders 510, 512 on opposite sides of power chamber or cylinder 508. As shown in FIG. 5, each of the pair of pumping cylinders 510, 512 is of smaller diameter than power chamber or cylinder 508. However, each of the pair of pumping cylinders 510, 512 need not be of smaller diameter than power chamber or cylinder 508. As those of ordinary skill in the art will appreciate, housing 506 may be a single or multi-piece housing. For example, the pair of pumping cylinders 510, 512 may each be in a separate housing from power chamber or cylinder 508. Housing 506 further includes a pair of power fluid intake ports 514, 516 connected to power chamber or cylinder 508 and a pair of power fluid exhaust ports 518, 520 connected to power chamber or cylinder 508. Slidably disposed within power chamber or cylinder 508 is piston assembly 522 that includes a central piston 524 and a pair of high-pressure pistons 526, 528 of smaller diameter than central piston 524 that extend oppositely from central piston 524 into the pair of pumping cylinders 510, 512. The ratio of the diameter of central piston 524 to the diameter of the pair of high-pressure pistons 526, 528 may be varied, inter alia, to modify the compression ratio of the first double-acting pump 502. Furthermore, piston assembly 522 may be made of multiple pieces, inter alia, to permit replacement of the pair of high-pressure pistons 526, 528 independently to the replacement of central piston 524. At the opposite ends of housing 506 are a pair of valve assemblies 530, 532 that permit the inflow of the low-pressure fluid to be pumped into each pumping cylinder 510, 512 on the intake stroke, and the outflow of high-pressure fluid from each pumping cylinder 510, 512 on the power stroke. In some embodiments, the pair of valve assemblies 530, 532 may comprise a check or a ball valve. The low-pressure fluid may be any of a variety of fluids, including water (e.g., seawater) and subterranean treatment fluids (e.g., drilling fluids, workover fluids, and completion fluids). Other fluids may be pumped by first double-acting pump 502 as desired by one of ordinary skill in the art. Furthermore, additional components, such as a sealing means between housing 506 and the pair of high-pressure pistons 526, 528, may be included in first double-acting pump 502 as desired.

Generally, second double-acting pump 504 includes housing 534 that defines power chamber or cylinder 536 and a pair of pumping cylinders 538, 540 on opposite sides of power chamber or cylinder 536. As shown in FIG. 5, each of the pair of pumping cylinders 538, 540 is of smaller diameter than power chamber or cylinder 536. However, each of the pair of pumping cylinders 538, 540 need not be of smaller diameter than power chamber or cylinder 536. As those of ordinary skill in the art will appreciate, housing 534 may be a single or multi-piece housing. For example, the pair of pumping cylinders 538, 540 may each be in a separate housing from power chamber or cylinder 536. Housing 534 further includes a pair of power fluid intake ports 542, 544 connected to power chamber or cylinder 536 and a pair of power fluid and a pair of power fluid exhaust ports 546, 548 connected to power chamber or cylinder 536. Slidably disposed within power chamber or cylinder 536 is piston assembly 550 that includes a central piston 552 and a pair of high-pressure pistons 554, 556 of smaller diameter than central piston 552 that extend oppositely from central piston 552 into the pair of pumping cylinders 538, 540. The ratio of the diameter of central piston 552 to the diameter of the pair of high-pressure pistons 554, 556 may be varied, inter alia, to modify the compression ratio of second double-acting pump 504. Furthermore, piston assembly 550 may be made of multiple pieces, inter alia, to permit replacement of the pair of high-pressure pistons 554, 556 independently to the replacement of central piston 552. At the opposite ends of housing 534 are a pair of valve assemblies 558, 560 that permit the inflow of the low-pressure fluid to be pumped into each pumping cylinder 538, 540 on the intake stroke, and the outflow of high-pressure fluid from each of pumping cylinder 538, 540 on the power stroke. In some embodiments, the pair of valve assemblies 558, 560 may comprise a check or a ball valve. The low-pressure fluid may be any of a variety of fluids, including water (e.g., seawater) and subterranean treatment fluids (e.g., drilling fluids, workover fluids, and completion fluids). Other fluids may be pumped by second double-acting pump 504 as desired by one of ordinary skill in the art. Furthermore, additional components, such as a sealing means between housing 534 and the pair of high-pressure pistons 554, 556, may be included in second double-acting pump 504 as desired.

First double-acting pump 502 is connected to first spool valve 102 of fluid control system 100 by a variety of fluid flow lines. These fluid flow lines are used to direct power fluid to first double-acting pump 502 or to direct power fluid expelled from first double-acting pump 502 to first spool valve 102. Fluid exhaust inlet 114 of first spool valve 102 and power fluid exhaust port 518 of first double-acting pump 502 are connected via power fluid exhaust line 562. Fluid supply port 118 of first spool valve 102 and power fluid intake port 514 of first double-acting pump 502 are connected via power fluid intake line 564. Furthermore, fluid intake line 564 connects power fluid intake port 514 of first double-acting pump 502 to fluid supply port 120 of first spool valve 102 by its branch 565. Fluid exhaust inlet 116 of first spool valve 102 and power fluid exhaust port 520 of first double-acting pump 502 are connected via power fluid exhaust line 566. Fluid supply port 124 of first spool valve 102 and power fluid intake port 516 of first double-acting pump 502 are connected via power fluid intake line 568. Furthermore, power fluid intake line 568 connects power fluid intake port 516 of first double-acting pump 502 to fluid supply port 122 of first spool valve 102 by its branch 569. In some embodiments, the plurality of fluid flow lines that connect first spool valve 102 and first double-acting pump 502 may be pipes or hoses that extend between them. In another embodiment, first spool valve 102 and first double-acting pump 502 may be connected by a manifold, wherein the fluid flow lines that connect them would be passages in the manifold extending between first spool valve 102 and first double-acting pump 502.

Second double-acting pump 504 is connected to second spool valve 104 of fluid control system 100 by a variety of fluid flow lines. These fluid flow lines are used to direct power fluid to second double-acting pump 504 or to direct power fluid expelled from second double-acting pump 504 to second spool valve 104. Fluid exhaust inlet 168 of second spool valve 104 and power fluid exhaust port 546 of second double-acting pump 504 are connected via power fluid exhaust line 570. Fluid supply port 172 of second spool valve 104 and power fluid intake port 542 of second double-acting pump 504 are connected via power fluid intake line 572. Furthermore, power intake line 572 connects power fluid intake port 542 of second double-acting pump 504 to fluid supply port 174 of second spool valve 104 by its branch 573. Fluid exhaust inlet 170 of second spool valve 104 and power fluid exhaust port 520 of second double-acting pump 504 are connected via power fluid exhaust line 574. Fluid supply port 178 of second spool valve 104 and power fluid intake port 544 of second double-acting pump 504 are connected via power fluid intake line 576. Furthermore, power intake line 576 connects power fluid intake port 544 of second double-acting pump 504 to fluid supply port 176 of second spool valve 104 by its branch 577. In some embodiments, the plurality of fluid flow lines that connect second spool valve 104 and second double-acting pump 504 may be pipes or hoses that extend between them. In another embodiment, second spool valve 104 and second double-acting pump 504 may be connected by a manifold, where the fluid flow lines that connect them would be passages in the manifold extending between first spool valve 102 and first double-acting pump 502.

First spool valve 102 is connected in fluid communication to load P, e.g., a source of pressurized power fluid, such as a pump (not shown) or a pressurized reservoir (not shown), by a plurality of fluid lines (not shown) that are connected to the four load ports 126, 128, 130, 132 of first spool valve 102. In some embodiments, the source of the pressurized power fluid may be a high pressure pump. First spool valve 102 is connected to a power fluid return T, such as a tank (not shown) or sump (not shown), by a plurality of fluid lines (not shown) that are connected to the two fluid return ports 110, 112 of first spool valve 102. Second spool valve 104 is connected in fluid communication to a load P, e.g., a source of pressurized power fluid, such as a pump (not shown) or a pressurized reservoir (not shown), by a plurality of fluid lines (not shown) that are connected to the four load ports 180, 182, 184, 186 of second spool valve 104. In some embodiments, the source of the pressurized power fluid may be a high pressure pump. Second spool valve 104 is connected to a power fluid return T, such as a tank (not shown) or sump (not shown), by a plurality of fluid lines (not shown) that are connected to the two fluid return ports 164, 166 of second spool valve 104. As those of ordinary skill in the art will appreciate, the power fluid return T should be a lower pressure than the load P. Generally, the load P will be the same for first spool valve 102 and second spool valve 104. Likewise, the power fluid return T will also be the same for first spool valve 102 and second spool valve 104. Even further, for example, the power fluid return T and load P may be located remote to the fluid control system 100, for example, where fluid control system 100 is located subsurface, or may be located proximate to fluid control system 100. The power fluid may be any of a variety of power fluids suitable for driving a pump, including, but not limited to, hydraulic fluids and water.

Furthermore, first shifting mechanism 580 for shifting first spool valve 102 between a first position and a second position is shown connected to first spool valve 102 and first double-acting pump 502. Second shifting mechanism 582 for shifting second spool valve 104 between a first position and a second position is shown connected to second spool valve 104 and second double-acting pump 504. First shifting mechanism 580 and second shifting mechanism 582 may be any suitable shifting mechanism for shifting the spool valves between their two positions. For example, the shifting mechanisms may operate mechanically, hydraulically, electrically, or by any other suitable method of operation. Those of ordinary skill in the art will be able to select and implement the appropriate shifting mechanism to shift the spool valves between their two positions.

Figure 6:
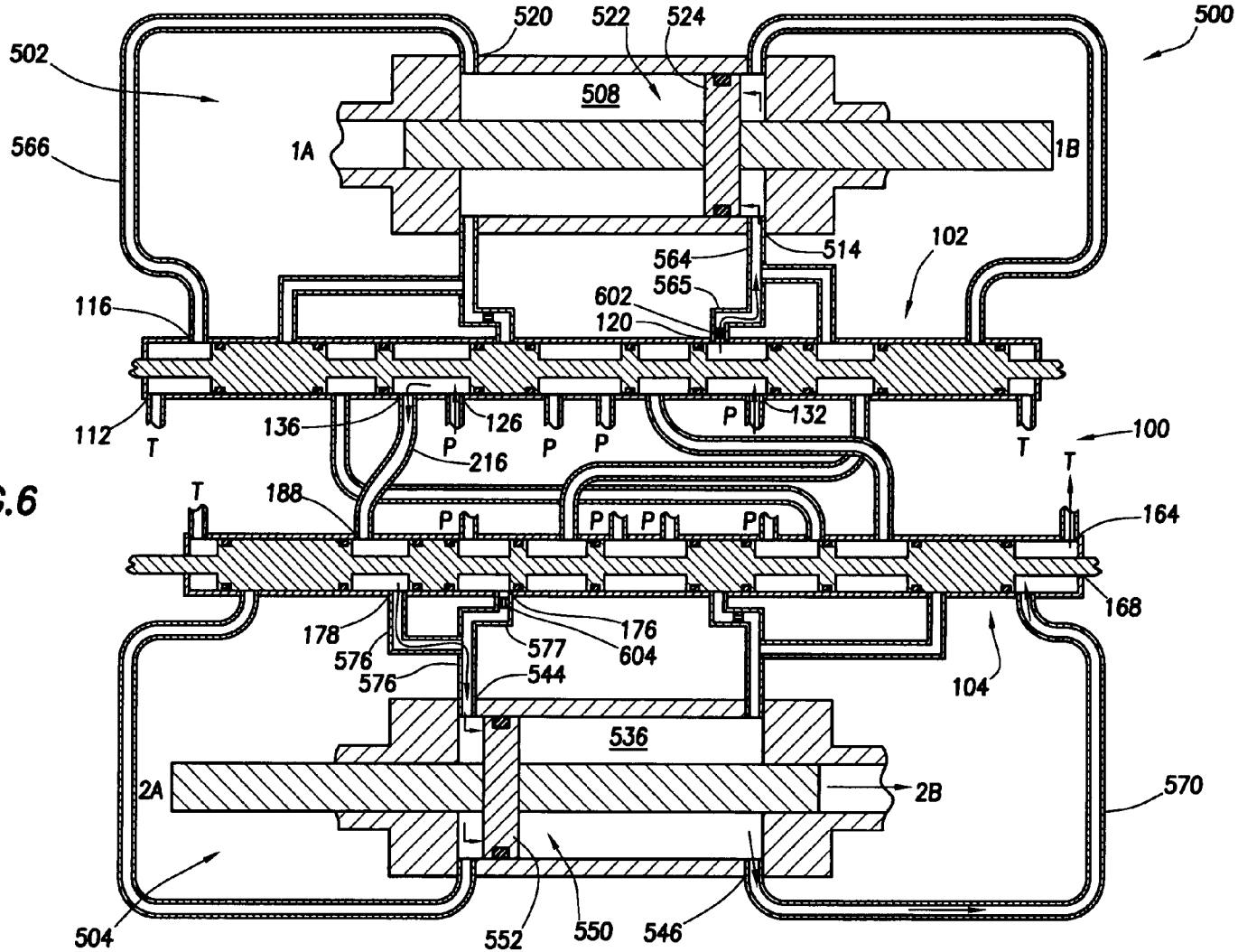
FIG. 6 is a schematic diagram of a fluid control system of the present invention connected to the power chambers of a double-acting, duplex pump in accordance with an embodiment of the present invention, wherein the first spool valve is in a first position and the second spool valve is in a second position.
Figure 7:
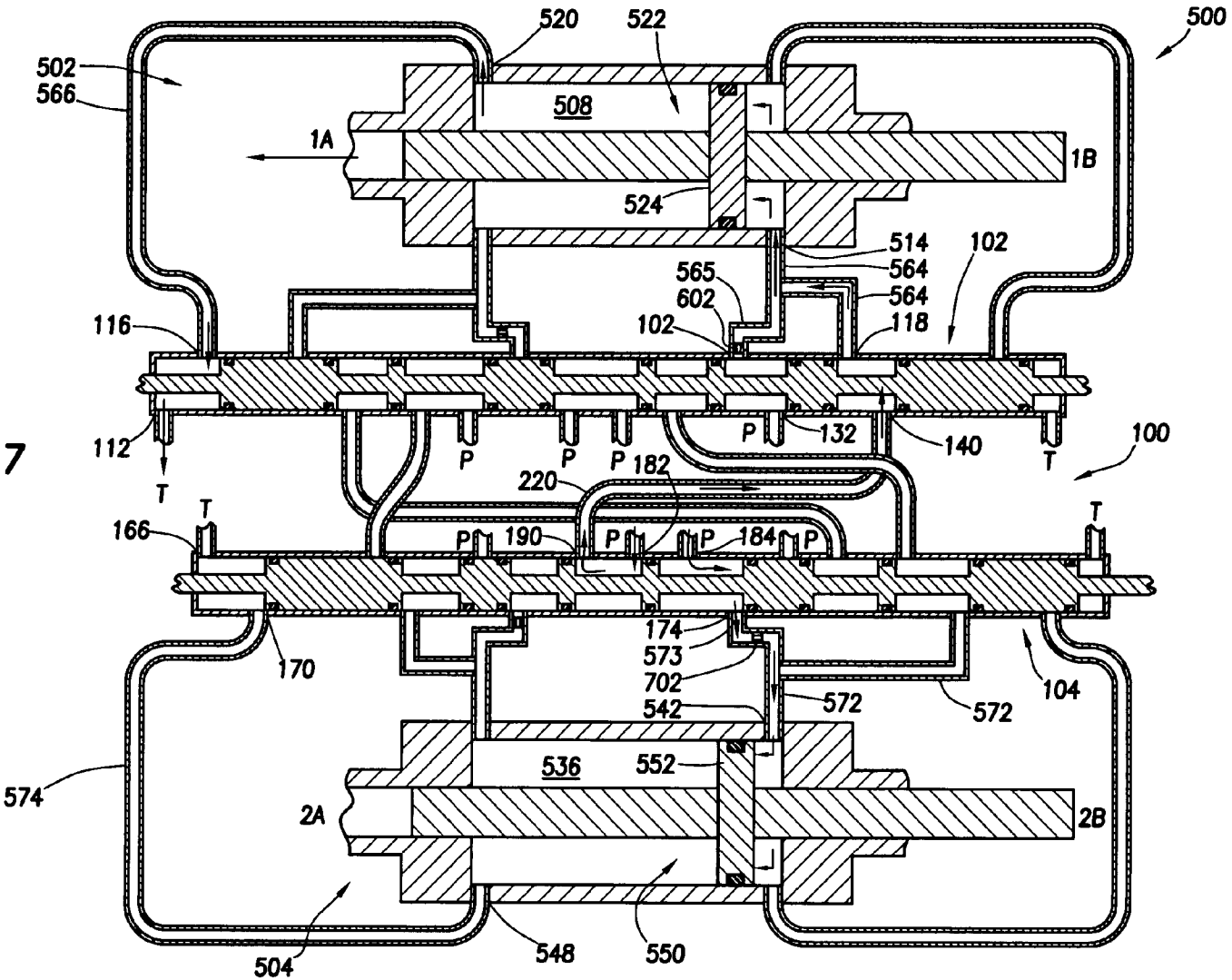
FIG. 7 is a schematic diagram of a fluid control system of the present invention connected to the power chambers of a double-acting, duplex pump in accordance with an embodiment of the present invention, wherein the first spool valve is in a first position and the second spool valve is in a first position.
Figure 8:
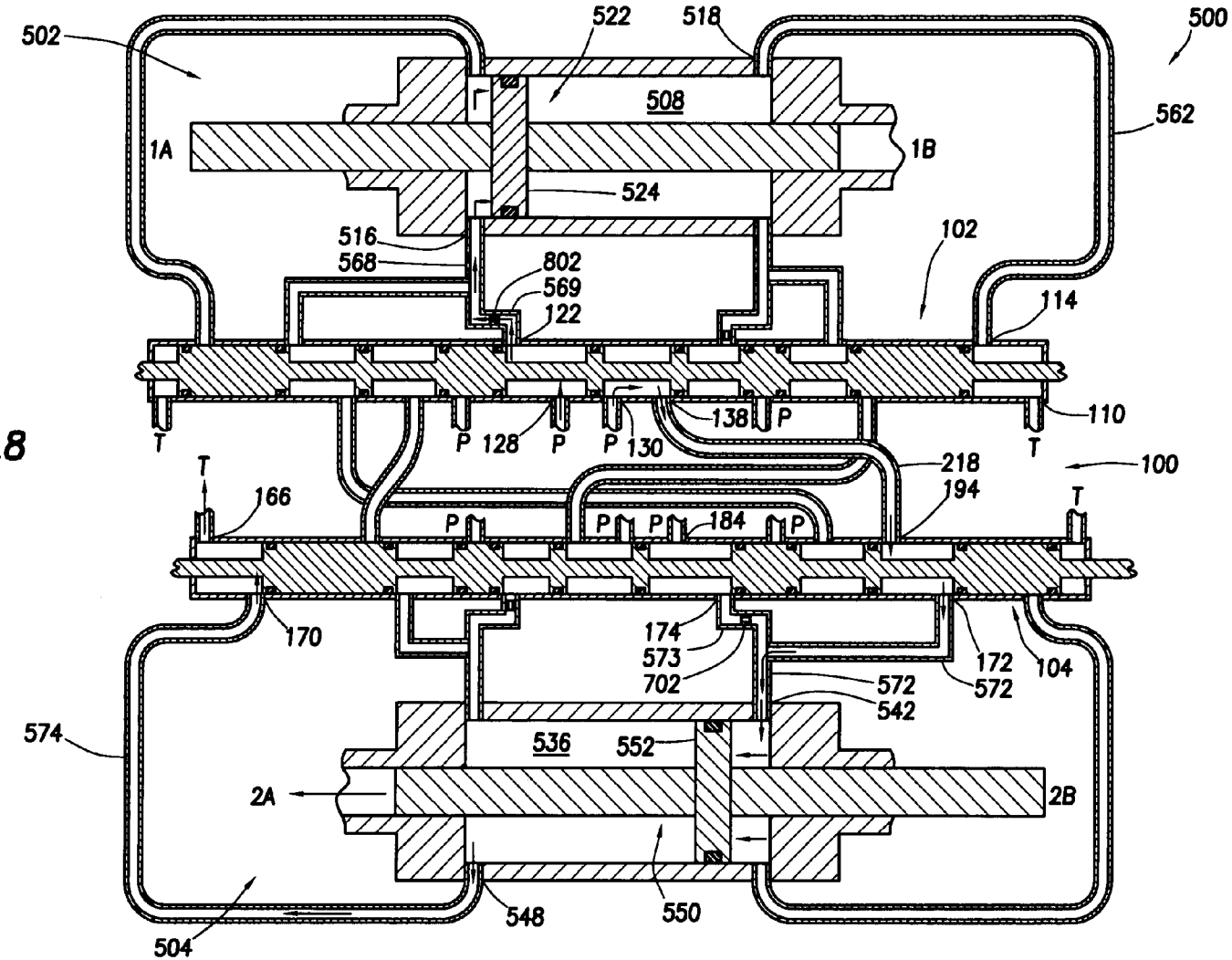
FIG. 8 is a schematic diagram of a fluid control system of the present invention connected to the power chambers of a double-acting, duplex pump in accordance with an embodiment of the present invention, wherein the first spool valve is in a second position and the second spool valve is in a first position.
Figure 9:
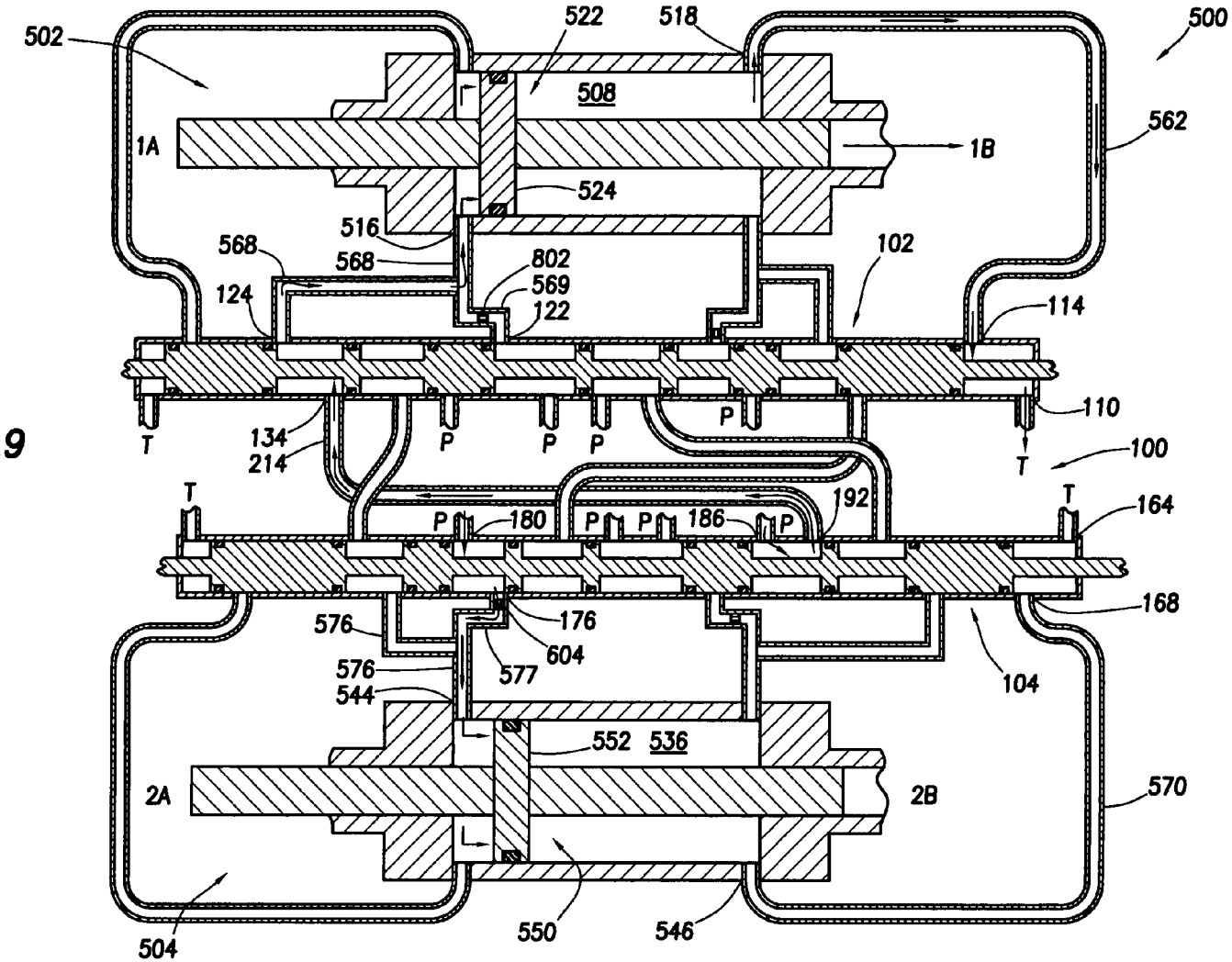
FIG. 9 is a schematic diagram of a fluid control system of the present invention connected to the power chambers of a double-acting, duplex pump in accordance with an embodiment of the present invention, wherein the first spool valve is in a second position and the second spool valve is in a second position.

Operation of fluid control system 100 to control double-acting, duplex pump 500 will be described in more detail by FIG. 6 through FIG. 9. Pumping cylinders 510, 512 of first double-acting pump 502, valve assemblies 530, 532 of first double-acting pump 502, pumping cylinders 538, 540 of second double-acting pump 504, valve assemblies 558, 560 of second double-acting pump 504, first shifting mechanism 580, and second shifting mechanism 582 are omitted from FIG. 6 through FIG. 9 because the present invention does not lie in their details. FIG. 6 illustrates fluid control system 100 with first spool valve 102 in its first position and second spool valve 104 in its second position. FIG. 7 illustrates fluid control system 100 with first spool valve 102 in its first position and second spool valve 104 in its first position. FIG. 8 illustrates fluid control system 100 with first spool valve 102 in its second position and second spool valve 104 in its first position. FIG. 9 illustrates fluid control system 100 with first spool valve 102 in its second position and second spool valve 104 in its second position.

Referring now to FIG. 6, first spool valve 102 is shown in its first position and second spool valve 104 is shown in its second position. In this position, fluid control system 100 directs the flow of power fluid so that piston assembly 550 of second double-acting pump 504 is on a power stroke and piston assembly 522 of first double-acting pump 502 is on a precompression stroke.

Power fluid exhaust port 520 of first double-acting pump 502 is connected to a power fluid return T via power fluid exhaust line 566, fluid exhaust inlet 116 of first spool valve 102, and fluid return port 112 of first spool valve 102. Power fluid intake port 514 of first double-acting pump 502 is connected in fluid communication with a load P, e.g., a source of pressurized power fluid (not shown), via power fluid intake line 564, branch 565 of power fluid intake line 564, fluid supply port 120 of first spool valve 102, and load port 132 of first spool valve 102. Branch 565 of power fluid intake line 564 includes flow restriction 602, e.g., an orifice, in the fluid flow path therethrough. Flow restriction 602 restricts the flow of power fluid through branch 565. In some embodiments, flow restriction 602 may be a variable orifice.

Power fluid exhaust port 546 of second double-acting pump 504 is connected to a power fluid return T via power fluid exhaust line 570, fluid exhaust inlet 168 of second spool valve 104, and fluid return port 164 of second spool valve 104. Power chamber or cylinder 536 of second double-acting pump 504 is connected in fluid communication with a load P, e.g., a source of pressurized power fluid, via fluid control system 100. Power fluid intake port 544 of second double-acting pump 504 is connected in fluid communication with fluid supply port 178 of second spool valve 104 via power fluid intake line 576. Load port 126 of first spool valve 102 is in fluid communication with fluid supply port 178 of second spool valve 104 via connector port 136 of first spool valve 102, fluid flow line 216, and connector port 188 of second spool valve. Accordingly, power fluid intake port 544 of second double-acting pump 504 is connected in fluid communication to load P, e.g., a source of pressurized power fluid (not shown), via load port 126 of first spool valve 102, connector port 136 of first spool valve 102, fluid flow line 216, connector port 188 of second spool valve 104, fluid supply port 178 of second spool valve 104, and fluid intake line 576. Power fluid intake port 544 of second double-acting pump 504 is also connected in fluid communication with a load P, e.g., a source of power fluid supply (not shown), via power fluid intake line 576, branch 577 of power fluid intake line 576, fluid supply port 176 of second spool valve 104, and load port 180 of second spool valve 104. However, branch 577 of power fluid intake line 576 includes a flow restriction 604, e.g., an orifice, in the fluid flow path therethrough. Flow restriction 604 restricts the flow of power fluid through branch 577. In some embodiments, flow restriction 604 may be a variable orifice.

In operation, as illustrated in FIG. 6, a first portion of the pressurized power fluid is directed to power chamber or cylinder 536 of second double-acting pump 504 via fluid control system 100. The first portion of the pressurized power fluid from the load P (e.g., the source of the pressurized power fluid) is directed to second spool valve 104 via first spool valve 102. The first portion of the pressurized power fluid directed to second spool valve 104 is directed to the power chamber or cylinder 536 of second double-acting pump 504. More particularly, the first portion of the pressurized power fluid flows into first spool valve 102 via load port 126 and then into second spool valve 104 via connector port 136 of first spool valve 102, fluid flow line 216, and connector port 188 of second spool valve 102. The first portion of the pressurized power fluid then flows into power chamber or cylinder 536 on one side of central piston 552 via fluid supply port 178 of second spool valve 104, power fluid intake line 576, and power fluid intake port 544. The first portion of the pressurized power fluid directed to power chamber or cylinder 536 applies pressure on central piston 552 and moves piston assembly 550 to the right so that piston assembly 550 of second double-acting pump 504 is on a power stroke. As piston assembly 550 is moved to the right, power fluid is discharged from power chamber or cylinder 536 of second double-acting pump 504 on the other side of central piston 552 and directed to a power fluid return T via fluid control system 100. More particularly, the discharged power fluid flows to second spool valve 104 via power fluid exhaust port 546, power fluid exhaust line 570, and fluid exhaust inlet 168 of second spool valve 104. Next, the discharged power fluid flows to a power fluid return T via fluid return port 164 of second spool valve 104. Those of ordinary skill in the art will appreciate, that as piston assembly 550 is moved to the right high-pressure fluid is discharged from second double-acting pump 504 via valve assembly 560 (shown on FIG. 5) and the low-pressure fluid to be pumped enters second double-acting discharge pump 504 via valve assembly 558 (shown on FIG. 5). At a predetermined point in the power stroke of piston assembly 550 of second double-acting pump 504, e.g., when piston assembly 550 reaches the end of its stroke, second shifting mechanism 582 (shown on FIG. 5) shifts second spool valve 104 to its first position. As previously discussed, this may be accomplished mechanically, hydraulically, electrically, or by any other suitable mechanism.

Furthermore, while the piston assembly 550 of second double-acting pump 504 is on a power stroke, piston assembly 522 of first double-acting pump 502 is on a precompression stroke. Accordingly, a second portion of the pressurized power fluid is directed to power chamber or cylinder 508 of first double-acting pump 502 via first spool valve 102. More particularly, the second portion of the pressurized power fluid flows into first spool valve 102 via load port 132 of first spool valve 102 and then into power chamber or cylinder 508 on one side of central piston 524 via fluid supply port 120 of first spool valve 102, branch 565 of power fluid intake line 564, power fluid intake line 564, and power fluid intake port 514. The flow of the second portion of the pressurized power fluid is restricted so that piston assembly 522 of first double-acting pump 502 is on a precompression stroke. To restrict the flow of the second portion of the pressurized power fluid into power chamber or cylinder 508 of first double-acting pump 502, branch 565 of power fluid intake line 564 includes flow restriction 602 in the fluid flow path therethrough. Flow restriction 602 should be designed to control the pressure applied by the power fluid to central piston 524 so that the low-pressure fluid to be pumped in pumping cylinder 510 of first double-acting pump 504 is brought up to the desired operating pressure prior to the compression stroke. During the precompression stroke, the second portion of the pressurized power fluid applies pressure to central piston 524 and may move piston assembly 522 to the left. As piston assembly 522 is moved to the left, power fluid is discharged from power chamber or cylinder 508 of first double-acting pump 502 on the other side of central piston 524 and directed to a power fluid return T via fluid control system 100. More particularly, the discharged power fluid flows to first spool valve 102 via power fluid exhaust port 520, power fluid exhaust line 566, and fluid exhaust inlet 116 of first spool valve 102. Next, the discharged power fluid flows to a power fluid return T via fluid return port 112 of first spool valve 102.

Referring now to FIG. 7, first spool valve 102 is shown in its first position and second spool valve 104 is shown in its first position. In this position, fluid control system 100 directs the flow of power fluid so that piston assembly 522 of first double-acting pump 502 is on a power stroke, and piston assembly 550 of second end of second double-acting pump 504 is on a precompression stroke.

Power fluid exhaust port 548 of second double-acting pump 504 is connected in fluid communication to a power fluid return T via power fluid exhaust line 574, fluid exhaust inlet 170 of second spool valve 104, and fluid return port 166 of second spool valve 104. Power fluid intake port 542 of second double-acting pump 504 is connected in fluid communication with a load P, e.g., a source of pressurized power fluid (not shown), via power fluid intake line 572, branch 573 of power fluid intake line 572, fluid supply port 174 of second spool valve 104, and load port 184 of second spool valve 104. Branch 573 of power fluid intake line 572 includes flow restriction 702, e.g., an orifice, in the fluid flow path therethrough. Flow restriction 702 restricts the flow of power fluid through branch 573. In some embodiments, flow restriction 702 may be a variable orifice.

Power fluid exhaust port 520 of first double-acting pump 502 is connected to a power fluid return T via power fluid exhaust line 566, fluid exhaust inlet 116 of first spool valve 102, and fluid return port 112 of first spool valve 102. Power chamber or cylinder 508 of first double-acting pump 502 is connected in fluid communication with a load P, e.g., a source of pressurized power fluid, via fluid control system 100. Power fluid intake port 514 of first double-acting pump 502 is connected in fluid communication with fluid supply port 118 of first spool valve 102 via power fluid intake line 564. Load port 182 of second spool valve is in fluid communication with fluid supply port 118 of first spool valve 102 via connector port 190 of second spool valve 104, fluid flow line 220, and connector port 140 of first spool valve 102. Accordingly, power fluid intake port 514 of first double-acting pump 502 is connected in fluid communication to a load P, e.g., a source of pressurized power fluid (not shown), via load port 182 of second spool valve 104, connector port 190 of second spool valve 104, fluid flow line 220, connector port 140 of first spool valve 102, fluid supply port 118 of first spool valve 102, and power fluid intake line 564. Power fluid intake port 514 of first double-acting pump 502 is also connected in fluid communication with a load P, e.g., a source of power fluid supply (not shown), via power fluid intake line 564, branch 565 of power fluid intake line 564, fluid supply port 120 of first spool valve 102, and load port 132 of first spool valve 102. However, branch 565 of power fluid intake line 564 includes flow restriction 602 that restricts the flow of power fluid through branch 565.

In operation, as illustrated in FIG. 7, a third portion of the pressurized power fluid is directed to power chamber or cylinder 508 of first double-acting pump 502 via fluid control system 100. The third portion of the pressurized power fluid from the load P (e.g., the source of the pressurized power fluid) is directed to first spool valve 102 via second spool valve 104. The third portion of the pressurized power fluid directed to first spool valve 102 is directed to the power chamber or cylinder 508 of first double-acting pump 502. More particularly, the third portion of the pressurized power fluid flows into second spool valve 104 via load port 182 and then into first spool valve 102 via connector port 190 of second spool valve 104, fluid flow line 220, and connector port 140 of first spool valve 104. The third portion of the pressurized power fluid then flows into power chamber or cylinder 508 on one side of central piston 524 via fluid supply port 118 of first spool valve 102, power fluid intake line 564, and power fluid intake port 514. The third portion of the pressurized power fluid directed to power chamber or cylinder 508 applies pressure on central piston 524 and moves piston assembly 522 to the left so that piston assembly 522 of first double-acting pump 502 is on a power stroke. As piston assembly 522 is moved to the left, power fluid is discharged from power chamber or cylinder 508 of first double-acting pump 502 on the other side of central piston 524 and directed to a power fluid return T via fluid control system 100. More particularly, the discharged power fluid flows to first spool valve 102 via power fluid exhaust port 520, power fluid exhaust line 566, and fluid exhaust inlet 116 of first spool valve 102. Next, the discharged power fluid flows to a power fluid return T via fluid return port 112 of first spool valve 102. Those of ordinary skill in the art will appreciate, that as piston assembly 522 is moved to the left high-pressure fluid is discharged from first double-acting pump 502 via valve assembly 530 (shown on FIG. 5) of first double-acting pump 502 and the low-pressure fluid to be pumped enters first double-acting pump 502 via valve assembly 532 (shown on FIG. 5) of first double-acting pump 502. At a predetermined point in the power stroke of piston assembly 522 of first double-acting pump 502, e.g., when piston assembly 522 reaches the end of its stroke, first shifting mechanism 580 (shown on FIG. 5) shifts first spool valve 102 to its second position. As previously discussed, this may be accomplished mechanically, hydraulically, electrically, or by any other suitable mechanism.

Furthermore, while piston assembly 522 of first double-acting pump 502 is on a power stroke, piston assembly 550 of second double-acting pump 504 is on a precompression stroke. Accordingly, a fourth portion of the pressurized power fluid is directed to power chamber or cylinder 536 of second double-acting pump 504 via second spool valve 104. More particularly, the fourth portion of the pressurized power fluid flows into second spool valve 104 via load port 184 of second spool valve 104 and then into power chamber or cylinder 536 on one side of central piston 552 via fluid supply port 174 of second spool valve 104, branch 573 of power fluid intake line 572, power fluid intake line 572, and power fluid intake port 542. The flow of the fourth portion of the pressurized power fluid is restricted so that piston assembly 550 of second double-acting pump 504 is on a precompression stroke. To restrict the flow of the fourth portion of the pressurized power fluid into power chamber or cylinder 536 of second double-acting pump 504, branch 573 of power fluid intake line 572 includes flow restriction 702 in the fluid flow path therethrough. Flow restriction 702 should be designed to control the pressure applied by the power fluid to central piston 552 so that the low-pressure fluid to be pumped in pumping cylinder 538 of second double-acting pump 502 is brought up to the desired operating pressure during the precompression stroke. During the precompression stroke, the fourth portion of the pressurized power fluid applies pressure to central piston 552 and may move piston assembly 550 to the left. As piston assembly 550 is moved to the left, power fluid is discharged from power chamber or cylinder 536 of second double-acting pump 502 on the other side of central piston 552 and directed to a power fluid return T via fluid control system 100. More particularly, the discharged power fluid flows to second spool valve 104 via power fluid exhaust port 548, power fluid exhaust line 574, and fluid exhaust inlet 170 of second spool valve 104. Next, the discharged power fluid flows to a power fluid return T via fluid return port 166 of second spool valve 104.

Referring now to FIG. 8, first spool valve 102 is shown in its second position and second spool valve 104 is shown in its first position. In this position, fluid control system 100 directs the flow of power fluid so that piston assembly 550 of second double-acting pump 504 is on a power stroke and piston assembly 522 of first double-acting pump 502 is on a precompression stroke.

Power fluid exhaust port 518 of first double-acting pump 502 is connected in fluid communication to a power fluid return T via power fluid exhaust line 562, fluid exhaust inlet 114 of first spool valve 102, and fluid return port 110 of first spool valve 102. Power fluid intake port 516 of first double-acting pump 502 is connected in fluid communication with a load P, e.g., a source of pressurized power fluid (not shown), via power fluid intake line 568, branch 569 of power fluid intake line 568, fluid supply port 122 of first spool valve 102, and load port 128 of first spool valve 102. Branch 569 of power fluid intake line 568 includes flow restriction 802, e.g., an orifice, in the fluid flow path therethrough. Flow restriction 802 restricts the flow of power fluid through branch 569. In some embodiments, flow restriction 802 may be a variable orifice.

Power fluid exhaust port 548 of second double-acting pump 504 is connected to a power fluid return T via power fluid exhaust line 574, fluid exhaust inlet 170 of second spool valve 104, and fluid return port 166 of second spool valve 104. Power chamber or cylinder 536 of second double-acting pump 504 is connected in fluid communication with a load P, e.g., a source of pressurized power fluid, via fluid control system 100. Power fluid intake port 542 of second double-acting pump 504 is connected in fluid communication with fluid supply port 172 of second spool valve 104 via power fluid intake line 572. Load port 130 of first spool valve 102 is in fluid communication with fluid supply port 172 of second spool valve 104 via connector port 138 of first spool valve 102, fluid flow line 218, and connector port 194 of second spool valve 104. Accordingly, power fluid intake port 542 of second double-acting pump 504 is connected in fluid communication to a load P, e.g., a source of pressurized power fluid (not shown), via load port 130 of first spool valve 102, connector port 138 of first spool valve 102, fluid flow line 218, connector port 194 of second spool valve 104, fluid supply port 172 of second spool valve 104, and power fluid intake line 572. Power fluid intake port 542 of second double-acting pump 504 is also connected in fluid communication with a load P, e.g., a source of power fluid supply (not shown), via power fluid intake line 572, branch 573 of power fluid intake line 572, fluid supply port 174 of second spool valve 104, and load port 184 of second spool valve 104. However, branch 573 of power fluid intake line 572 includes flow restriction 702 that restricts the flow of power fluid through branch 573.

In operation, as illustrated in FIG. 8, a fifth portion of the pressurized power fluid is directed to power chamber or cylinder 536 of second double-acting pump 504 via fluid control system 100. The fifth portion of the pressurized power fluid from the load P (e.g., the source of the pressurized power fluid) is directed to second spool valve 104 via first spool valve 102. The fifth portion of the pressurized power fluid directed to second spool valve 104 is directed to the power chamber or cylinder 536 of second double-acting pump 504. More particularly, the fifth portion of the pressurized power fluid flows into first spool valve 102 via load port 130 and then into second spool valve 104 via connector port 138 of first spool valve 102, fluid flow line 218, and connector port 194 of second spool valve 102. The fifth portion of the pressurized power fluid then flows into power chamber or cylinder 536 on one side of central piston 552 via fluid supply port 172 of second spool valve 104, power fluid intake line 572, and power fluid intake port 542. The fifth portion of the pressurized power fluid directed to power chamber or cylinder 536 applies pressure on central piston 552 and moves piston assembly 550 to the left so that the piston assembly 550 of second double-acting pump is on a power stroke. As piston assembly 550 is moved to the left, power fluid is discharged from power chamber or cylinder 536 of double-acting intensifier pump 504 on the other side of central piston 552 and directed to a power fluid return T via fluid control system 100. More particularly, the discharged power fluid flows to second spool valve 104 via power fluid exhaust port 548, power fluid exhaust line 574, and fluid exhaust inlet 170 of second spool valve 104. Next, the discharged power fluid flows to a power fluid return T via fluid return port 166 of second spool valve 104. Those of ordinary skill in the art will appreciate, that as piston assembly 550 is moved to the left high-pressure fluid is discharged from second double-acting pump 504 via valve assembly 558 (shown on FIG. 5) of second double-acting pump 504 and the low-pressure fluid to be pumped enters second double-acting pump 504 valve assembly 560 (shown on FIG. 5) of second double-acting pump 504. At a predetermined point in the power stroke of piston assembly 550 of second double-acting pump 504, e.g., when piston assembly 550 reaches the end of its stroke, second shifting assembly 582 (shown on FIG. 5) shifts second spool valve 104 to its second position. As previously discussed, this may be accomplished mechanically, hydraulically, electrically, or by any other suitable mechanism.

Furthermore, while piston assembly 550 of second double-acting pump 504 is on a power stroke, piston assembly 522 of first double-acting pump 502 is on a precompression stroke. Accordingly, a sixth portion of the pressurized power fluid is directed to power chamber or cylinder 508 of first double-acting pump 502 via first spool valve 102. More particularly, the sixth portion of the pressurized power fluid flows into first spool valve 102 via load port 128 of first spool valve 102 and then into power chamber or cylinder 508 on one side of central piston 524 via fluid supply port 122 of first spool valve, branch 569 of power fluid intake line 568, power fluid intake line 568, and power fluid intake port 516. The flow of the sixth portion of the pressurized power fluid is restricted so that piston assembly 522 of first double-acting pump 502 is on a precompression stroke. To restrict the flow of the sixth portion of the pressurized power fluid into power chamber or cylinder 508 of first double-acting pump 502, branch 569 of power fluid intake line 568 includes flow restriction 802 in the fluid flow path therethrough. Flow restriction 802 should be designed to control the pressure applied by the power fluid to central piston 524 so that the low-pressure fluid to be pumped in pumping cylinder 512 of first double-acting pump 502 is brought up to the desired operating pressure during the precompression stroke. During the precompression stroke, the sixth portion of the pressurized power fluid applies pressure to central piston 524 and piston assembly 522 may be moved to the right. As piston assembly 522 is moved to the right, power fluid is discharged from power chamber or cylinder 508 of first double-acting pump 502 on the other side of central piston 524 and directed to a power fluid return T via fluid control system 100. More particularly, the discharged power fluid flows to first spool valve 102 via power fluid exhaust port 518, power fluid exhaust line 562 and fluid exhaust inlet 114 of first spool valve 102. Next, the discharged power fluid flows to a power fluid return T via fluid return port 110 of first spool valve 102.

Referring now to FIG. 9, first spool valve 102 is shown in its second position and second spool valve 104 is shown in its second position. In this position, fluid control system 100 directs the flow of power fluid so that piston assembly 522 of first double-acting pump 502 is on a power stroke and piston assembly 550 of second double-acting pump 504 is on a precompression stroke.

Power fluid exhaust port 546 of second double-acting pump 504 is connected in fluid communication to a power fluid return T via power fluid exhaust line 570, fluid exhaust inlet 168 of second spool valve 104, and fluid return port 164 of second spool valve 104. Power fluid intake port 544 of second double-acting pump 504 is connected in fluid communication with a load P, e.g., a source of pressurized power fluid (not shown), via power fluid intake line 576, branch 577 of power fluid intake line 576, fluid supply port 176 of second spool valve 104, and load port 180 of second spool valve 104. Branch 577 of power fluid intake line 568 includes flow restriction 604 that restricts the flow of power fluid through branch 577.

Power fluid exhaust port 518 of first double-acting pump 502 is connected to a power fluid return T via power fluid exhaust line 562, fluid exhaust inlet 114 of first spool valve 102, and fluid return port 110 of first spool valve 102. Power chamber or cylinder 508 of first double-acting pump 502 is connected in fluid communication with a load P, e.g., a source of pressurized power fluid (not shown), via fluid control system 100. Power fluid intake port 516 of first double-acting pump 502 is connected in fluid communication with fluid supply port 124 of first spool valve 102 via power fluid intake line 568. Load port 186 of second spool valve 104 is in fluid communication with fluid supply port 124 of first spool valve 102 via connector port 192 of second spool valve 104, fluid flow line 214, and connector port 134 of first spool valve 102. Accordingly, power fluid intake port 516 of first double-acting pump 502 is connected in fluid communication to a load P, e.g., a source of pressurized power fluid (not shown), via load port 186 of second spool valve 104, connector port 192 of second spool valve 104, fluid flow line 214, connector port 134 of first spool valve 102, fluid supply port 124 of first spool valve 102, and power fluid intake line 568. Power fluid intake port 516 of first double-acting pump 502 is also connected in fluid communication with a load P, e.g., a source of pressurized power fluid (not shown), via power fluid intake line 568, branch 569 of power fluid intake line 568, fluid supply port 122 of first spool valve 102, and load port 128 of first spool valve 102. However, branch 569 of power fluid intake line 568 includes flow restriction 802 that restricts the flow of power fluid through branch 565.

In operation, as illustrated in FIG. 9, a seventh portion of the pressurized power fluid is directed to power chamber or cylinder 508 of first double-acting pump 502 via fluid control system 100. The seventh portion of the pressurized power fluid from the load P (e.g., the source of the pressurized power fluid) is directed to first spool valve 102 via second spool valve 104. The seventh portion of the pressurized power fluid directed to first spool valve 102 is directed to the power chamber or cylinder 508 of first double-acting pump 502. More particularly, the seventh portion of the pressurized power fluid flows into second spool valve 104 via load port 186 and then into first spool valve 102 via connector port 192 of second spool valve 104, fluid flow line 214, and connector port 134 of first spool valve 104. The seventh portion of the pressurized power fluid then flows into power chamber or cylinder 508 on one side of central piston 524 via fluid supply port 124 of first spool valve 102, power fluid intake line 568, and power fluid intake port 516. The seventh portion of the pressurized power fluid directed to power chamber or cylinder 508 applies pressure on central piston 524 and moves piston assembly 522 to the right so that piston assembly 522 of first double-acting pump 502 is on a power stroke. As piston assembly 522 is moved to the right, power fluid is discharged from power chamber or cylinder 508 of first double-acting pump 502 on the other side of central piston 524 and directed to a power fluid return T via fluid control system 100. More particularly, the discharged power fluid flows to first spool valve 102 via power fluid exhaust port 518, power fluid exhaust line 562, and fluid exhaust inlet 114 of first spool valve 102. Next, the discharged power fluid flows to a power fluid return T via fluid return port 110 of first spool valve 102. Those of ordinary skill in the art will appreciate, that as piston assembly 522 is moved to the right high-pressure fluid is discharged from first double-acting pump 502 via valve assembly 532 (shown on FIG. 5) of first double-acting pump 502 and the low-pressure fluid to be pumped enters first double-acting pump 502 via valve assembly 530 (shown on FIG. 5) of first double-acting pump 502. At a predetermined point in the power stroke of piston assembly 522 of first double-acting pump 502, e.g., when piston assembly 522 reaches the end of its stroke, first shifting assembly 580 (shown on FIG. 5) shifts first spool valve 104 to its first position. As previously discussed, this may be accomplished mechanically, hydraulically, electrically, or by any other suitable mechanism.

Furthermore, while the piston assembly 522 of first double-acting pump 502 is on a power stroke, piston assembly 550 of second double-acting pump 504 is on a precompression stroke. Accordingly, an eighth portion of the pressurized power fluid is directed to power chamber or cylinder 536 of second double-acting pump 504 via second spool valve 104. More particularly, the eighth portion of the pressurized power fluid flows into second spool valve 104 via load port 180 of second spool valve 104 and then into power chamber or cylinder 536 on one side of central piston 552 via fluid supply port 176 of second spool valve 104, branch 577 of power fluid intake line 576, power fluid intake line 576, and power fluid intake port 544. The flow of the eighth portion of the pressurized power fluid is restricted so that piston assembly 550 of second double-acting pump 504 is on a precompression stroke. To restrict the flow of the eight portion of the pressurized power fluid into power chamber or cylinder 536 of second double-acting pump 504, branch 577 of power fluid intake line 576 includes flow restriction 604 in the fluid flow path therethrough. Flow restriction 604 should be designed to control the pressure applied by the power fluid to central piston 552 so that the low-pressure fluid to be pumped in pumping cylinder 540 of second double-acting pump 504 is brought up to the desired operating pressure during the precompression stroke. During the precompression stroke, the eighth portion of the pressurized power fluid applies pressure to central piston 552 and may move piston assembly 550 to the right. As piston assembly 550 is moved to the right, power fluid is discharged from power chamber or cylinder 536 of second double-acting pump 502 on the other side of central piston 552 and directed to a power fluid return T via fluid control system 100. More particularly, the discharged power fluid flows to second spool valve 104 via power fluid exhaust port 546, power fluid exhaust line 570, and fluid exhaust inlet 168 of second spool valve 104. Next, the discharged power fluid flows to a power fluid return T via fluid return port 164 of second spool valve 104.

Therefore, the present invention is well-adapted to carry out the objects and attain the ends and advantages mentioned as well as those which are inherent therein. While the invention has been depicted, described, and is defined by reference to exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. In particular, as those of skill in the art will appreciate, steps from the different methods disclosed herein can be combined in a different manner and order. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A fluid control system comprising:

a source of a pressurized fluid;

a first spool valve having at least two positions, wherein the first spool valve is connected in fluid communication with the source of the pressurized fluid;

a second spool valve having at least two positions, wherein the second spool valve is connected in fluid communication with the first spool valve and the source of the pressurized fluid; and a first pump comprising a power chamber;

wherein when the first spool valve is in a first position and the second spool valve is in a second position, the source of pressurized fluid is in fluid communication with a first supply port of the second spool valve via a first groove of the second spool valve and a first groove of the first spool valve, and the source of pressurized fluid is in fluid communication with a first supply port of the first spool valve via a second groove of the first spool valve; and wherein when the first spool valve is in the first position and the second spool valve is in the second position, the second groove of the first spool valve is in fluid communication with the power chamber of the first pump via the first spool valve.

2. The fluid control system of claim 1 wherein the fluid control system comprises a source of a first exhaust fluid, wherein when the first spool valve is in the first position and the second spool valve is in the second position, the source of the first exhaust fluid is in fluid communication with a fluid return via the first spool valve, and wherein the fluid return is at a lower pressure than the source of the pressurized fluid.

3. The fluid control system of claim 2 wherein the source of the first exhaust fluid is the power chamber of the first pump.

4. The fluid control system of claim 2 wherein the fluid control system comprises a second pump comprising a power chamber, and wherein when the first spool valve is in the first position and the second spool valve is in the second position, the first groove of the second spool valve is in fluid communication with the power chamber of the second pump.

5. The fluid control system of claim 4 wherein the fluid control system comprises a source of a second exhaust fluid, and wherein when the first spool valve is in the first position and the second spool valve is in the second position, the source of the second exhaust fluid is in fluid communication with the fluid return via the second spool valve.

6. The fluid control system of claim 5 wherein the source of the second exhaust fluid is the power chamber of the second pump.

7. The fluid control system of claim 1 wherein when the first spool valve is in the first position and the second spool valve is in a first position, the source of the pressurized fluid is in fluid communication with a second supply port of the first spool valve via a third groove of the first spool valve and a second groove of the second spool valve.

8. The fluid control system of claim 7 wherein the fluid control system comprises a first second pump comprising a power chamber, and wherein when the first spool valve is in the first position and the second spool valve is in a first position, the source of pressurized fluid is in fluid communication with the power chamber of the second pump via a third groove of the second spool valve.

9. The fluid control system of claim 8 wherein the fluid control system comprises a source of a first exhaust fluid and a source of a second exhaust fluid, wherein when the first spool valve is in the first position and the second spool valve is in the first position, the source of the second exhaust fluid is in fluid communication with a fluid return via the second spool valve, and wherein the fluid return is at a lower pressure than the source of the pressurized fluid.

10. The fluid control system of claim 9 wherein when the first spool valve is in the first position and the second spool valve is in a first position, the second supply port of the first spool valve is in fluid communication with the power chamber of the first pump.

11. The fluid control system of claim 10 wherein when the first spool valve is in the first position and the second spool valve is in the first position, the source of the first exhaust fluid is in fluid communication with the fluid return via the first spool valve.

12. The fluid control system of claim 7, wherein the second spool valve comprises a second supply port, a third supply port, a third groove and a fourth groove;

wherein when the first spool valve is in a second position and the second spool valve is in the first position, a portion of the pressurized fluid is directed from the source of the pressurized fluid to the second spool valve; and wherein the source of the pressurized fluid is in fluid communication with the third supply port of the second spool valve via a fourth groove of the first spool valve and the fourth groove of the second spool valve.

13. The fluid control system of claim 12 wherein when the first spool valve is in the second position and the second spool valve is in the first position the source of the pressurized fluid is in fluid communication with the power chamber of the first pump via a fifth groove of the first spool valve.

14. The fluid control system of claim 13 wherein the fluid control system comprises a source of a first exhaust fluid, wherein when the first spool valve is in the second position and the second spool valve is in the first position, the source of the first exhaust fluid is in fluid communication with a fluid return via the first spool valve, and wherein the fluid return is at a lower pressure than the source of the pressurized fluid.

15. The fluid control system of claim 14 wherein the fluid control system comprises a second pump comprising a power chamber, and wherein when the first spool valve is in the second position and the second spool valve is in the first position, the fourth groove of the second spool valve is in fluid communication with the power chamber of the second pump.

16. The fluid control system of claim 15 wherein the fluid control system comprises a source of a second exhaust fluid, and wherein when the first spool valve is in the second position and the second spool valve is in the first position, the source of the second exhaust fluid is in fluid communication with the fluid return via the second spool valve.

17. The fluid control system of claim 12 wherein the first spool valve comprises a third supply port, a fourth supply port, a fifth groove and a sixth groove; and wherein when the first spool valve is in the second position and the second spool valve is in the second position, the source of the pressurized fluid is in fluid communication with the fourth supply port of the first spool valve via the sixth groove of the first spool valve and a fifth groove of the second spool valve.

18. The fluid control system of claim 17 wherein the fluid control system comprises a duplex pump that is comprised of the first pump, wherein the first pump is a first double-acting pump, and the duplex pump further comprises a second double-acting pump; wherein the second double-acting pump comprises a power chamber, and wherein when the first spool valve is in the second position and the second spool valve is in the second position, the source of the pressurized fluid is in fluid communication with the power chamber of the second double-acting pump via a sixth groove of the second spool valve.

19. The fluid control system of claim 18 wherein when the first spool valve is in the second position and the second spool valve is in the second position, the power chamber of the second double-acting pump is in fluid communication with a fluid return via the second spool valve, and wherein the fluid return is at a lower pressure than the source of the pressurized fluid.

20. The fluid control system of claim 19 wherein when the first spool valve is in the second position and the second spool valve is in the second position, the sixth groove of the first spool valve is in fluid communication with the power chamber of the first double-acting pump.

21. The fluid control system of claim 20 wherein when the first spool valve is in the second position and the second spool valve is the second position, the power chamber of the first double-acting pump is in fluid communication with the fluid return via the first spool valve.

22. The fluid control system of claim 1 wherein the first spool valve comprises four connector ports, wherein each of the four connector ports of the first spool valve are in fluid communication with a corresponding connector port of the second spool valve.

23. The fluid control system of claim 1 wherein the first spool valve comprises a central spool that comprises eight grooved portions including the first groove of the first spool valve and the second groove of the first spool valve, and wherein the second spool valve comprises a central spool that comprises eight grooved portions including the first groove of the second spool valve.

24. The fluid control system of claim 23 wherein each grooved portion of the central spool of the first spool valve has a corresponding inlet port and a corresponding outlet port.

25. The fluid control system of claim 24 wherein each grooved portion of the central spool of the second spool valve has a corresponding inlet port and a corresponding outlet port.

26. The fluid control system of claim 1 wherein the first spool valve comprises four load ports coupled to the source of pressurized power fluid, and wherein the second spool valve comprises four load ports coupled to the source of the pressurized power fluid.

27. A pump system comprising:

a first double-acting pump comprising a power chamber;

a fluid control system comprising:

a first spool valve having at least two positions, wherein the first spool valve is connected in fluid communication to the power chamber of the first double-acting pump, and a second spool valve having at least two positions, wherein the second spool valve is connected in fluid communication to the first spool valve; and a second double-acting pump comprising a power chamber, the power chamber connected in fluid communication to the second spool valve;

wherein the power chamber of the first double-acting pump comprises a piston assembly slidably disposed therein;

wherein the piston assembly of the first double-acting pump comprises a central piston and a pair of high-pressure pistons that extend oppositely from the central piston into a pair of pumping cylinders, wherein the pair of pumping cylinders are on opposite sides of the power chamber;

wherein the fluid control system is configured to direct delivery of a pressurized fluid to the first double-acting pump and the second double-acting pump, wherein when the first spool valve is in a first position and the second spool valve is in a second position, a source of the pressurized fluid is in fluid communication with the power chamber of the second double acting pump via a first grooved portion of the first spool valve and a first grooved portion of the second spool valve.

28. The pump system of claim 27 wherein the pair of high-pressure pistons of the first double-acting pump are of smaller diameter than the central piston.

29. The pump system of claim 27 wherein the pair of pumping cylinders and the power chamber are located in separate housings.

30. The pump system of claim 27 wherein the power chamber of the second double-acting pump comprises a piston assembly slidably disposed therein.

31. The pump system of claim 30 wherein the piston assembly of the second double-acting pump comprises a central piston and a pair of high-pressure pistons that extend oppositely from the central piston into a pair of pumping cylinders, wherein the pair of pumping cylinders are on opposite sides of the power chamber.

32. The pump system of claim 31 wherein the pair of high-pressure pistons are of smaller diameter than the central piston.

33. The pump system of claim 31 wherein the pair of pumping cylinders and the power chamber are located in separate housings.

34. The pump system of claim 27 wherein the source of the pressurized power fluid is connected in fluid communication with the first spool valve and the second spool valve.

35. The pump system of claim 34 wherein when the first spool valve is in the first position and the second spool valve is in the second position, the source of the pressurized fluid is in fluid communication with the power chamber of the first double-acting pump via a second grooved portion of the first spool valve.

36. The pump system of claim 35 wherein the flow path from the source of the pressurized fluid to the power chamber of the first double-acting pump contains a restriction.

37. The pump system of claim 36 wherein the restriction comprises a variable orifice.

38. The pump system of claim 34 wherein the first spool valve comprises a second grooved portion and a third grooved portion; wherein when the first spool valve is in the first position and the second spool valve is in a first position, the source of the pressurized fluid is in fluid communication with a port of the first spool valve via a second grooved portion of the second spool valve and the third grooved portion of the first spool valve.

39. The pump system of claim 38 wherein when the first spool valve is in the first position and the second spool valve is in the first position, the third grooved portion of the first spool valve is in fluid communication with the power chamber of the first double-acting pump.

40. The pump system of claim 39 wherein when the first spool valve is in the first position and the second spool valve is in the first position, the source of the pressurized fluid is in fluid communication with the power chamber of the second double-acting pump via a third grooved portion of the second spool valve.

41. The pump system of claim 38 wherein the second spool valve comprises a third grooved portion and a fourth grooved portion; wherein when the first spool valve is in a second position and the second spool valve is in the first position, the source of the pressurized fluid is in fluid communication with a port of the second spool valve via a fourth grooved portion of the first spool valve and the fourth grooved portion of the second spool valve.

42. The pump system of claim 41 wherein when the first spool valve is in the second position and the second spool valve is in the first position, the fourth grooved portion of the second spool valve is in fluid communication with the power chamber of the second double-acting pump.

43. The pump system of claim 42 wherein when the first spool valve is in the second position and the second spool valve is in the first position, the source of the pressurized fluid is in fluid communication with the power chamber of the first double-acting pump via a fifth grooved portion of the first spool valve.

44. The pump system of claim 41 wherein the first spool valve comprises a fifth grooved portion and a sixth grooved portion, wherein when the first spool valve is in the second position and the second spool valve is in the second position, the source of the pressurized fluid is in fluid communication with a second port of the first spool valve via a fifth grooved portion of the second spool valve and a sixth grooved portion of the first spool valve.

45. The pump system of claim 44 wherein when the first spool valve is in the second position and the second spool valve is in the second position, the sixth grooved portion of the first spool valve is in fluid communication with the power chamber of the first double-acting pump.

46. The pump system of claim 45 wherein when the first spool valve is in the second position and the second spool valve is in the second position, the source of the pressurized fluid is in fluid communication with the power chamber of the second double-acting pump via a sixth grooved portion of the second spool valve.

47. The pump system of claim 27 wherein the first spool valve comprises four ports, wherein each of the four ports of the first spool valve are in fluid communication with a corresponding port of the second spool valve.

48. The pump system of claim 27 wherein the first spool valve comprise six ports coupled to the first double-acting pump, and wherein the second spool valve comprises six ports coupled to the second double-acting pump.

49. The pump system of claim 27 wherein the first spool valve comprises a central spool that comprises eight grooved portions, and wherein the second spool valve comprises a central spool that comprises eight grooved portions.

50. The pump system of claim 49 wherein each grooved portion of the central spool of the first spool valve has a corresponding inlet port and a corresponding outlet port.

51. The fluid control system of claim 50, wherein each grooved portion of the central spool of the second spool valve has a corresponding inlet port and a corresponding outlet port.

52. The fluid control system of claim 27, wherein the first spool valve comprises four ports coupled to the source of pressurized power fluid, and wherein the second spool valve comprises four ports coupled to the source of the pressurized power fluid.

53. A method of controlling a pump, comprising:

providing a first double-acting pump comprising a power chamber and a piston assembly slidably disposed within the power chamber;

providing a second double-acting pump comprising a power chamber and a piston assembly slidably disposed within the power chamber;

positioning a first spool valve in a first position, the first spool valve having at least two positions;

positioning a second spool valve in a second position, the second spool valve having at least two positions;

directing a first portion of a pressurized power fluid from a source of the pressurized power fluid to the second spool valve via the first spool valve, wherein the first portion of the pressurized power fluid flows from the first spool valve to the second spool valve, and wherein the first portion of the pressurized power fluid does not flow through the source of the pressurized power fluid on its way from the first spool valve to the second spool valve;

directing the first portion of the pressurized power fluid directed to the second spool valve to the power chamber of the second double-acting pump;

wherein the first portion of the pressurized power fluid directed to the power chamber of the second double-acting pump causes the piston assembly of the second double-acting pump to move so that the piston assembly of the second double-acting pump is on a power stroke when the first spool valve is in the first position and the second spool valve is in the second position; and directing a second portion of the pressurized power fluid from the source of the pressurized power fluid to the power chamber of the first double-acting pump via the first spool valve.

54. The method of claim 53 wherein the flow of the second portion of the pressurized power fluid directed to the power chamber of the first double-acting pump is restricted so that the piston assembly of the first double-acting pump is on a precompression stroke when the first spool valve is in the first position and the second spool valve is in the second position.

55. The method of claim 53 further comprising shifting the second spool valve to a first position at a predetermined point in the power stroke of the piston assembly of the second double-acting pump.

56. The method of claim 55 further comprising directing a third portion of the pressurized power fluid from the source of the pressurized power fluid to the first spool valve via the second spool valve when the first spool valve is in the first position and the second spool valve is in the first position.

57. The method of claim 56 further comprising directing the third portion of the pressurized power fluid directed to the first spool valve to the power chamber of the first double-acting pump.

58. The method of claim 57 wherein the third portion of the pressurized power fluid directed to the power chamber of the first double-acting pump causes the piston assembly of the first double-acting pump to move so that the piston assembly of the first double-acting pump is on a power stroke when the first spool valve is in the first position and the second spool valve is in the first position.

59. The method of claim 58 further comprising directing a fourth portion of the pressurized power fluid from the source of the pressurized power fluid to the power chamber of the second double-acting pump via the second spool valve when the first spool valve is in the first position and the second spool valve is in the first position.

60. The method of claim 59 wherein the flow of the fourth portion of the pressurized power fluid directed to the power chamber of the second double-acting pump is restricted so that the piston assembly of the second double-acting pump is on a precompression stroke when the first spool valve is in the first position and the second spool valve is in the first position.

61. The method of claim 58 further comprising shifting the first spool valve to a second position at a predetermined point in the power stroke of the piston assembly of the first double-acting pump.

62. The method of claim 61 further comprising:

directing a fourth portion of the pressurized power fluid from the source of the pressurized power fluid to the power chamber of the second double-acting pump via the second spool valve when the first spool valve is in the first position and the second spool valve is in the first position;

directing a fifth portion of the pressurized power fluid from the source of the pressurized power fluid to the second spool valve via the first spool valve when the first spool valve is in the second position and the second spool valve is in the first position; and directing the fifth portion of the pressurized power fluid directed to the second spool valve to the power chamber of the second double-acting pump.

63. The method of claim 62 wherein the fifth portion of the pressurized power fluid directed to the power chamber of the second double-acting pump causes the piston assembly of the second double-acting pump to move so that the piston assembly of the second double-acting pump is on a power stroke when the first spool valve is in the second position and the second spool valve is in the first position.

64. The method of claim 63 further comprising directing a sixth portion of the pressurized power fluid from the source of the pressurized power fluid to the power chamber of the first double-acting pump via the first spool valve when the first spool valve is in the second position and the second spool valve is in the first position.

65. The method of claim 63 further comprising shifting the second spool valve to the second position at a predetermined point in the power stroke of the piston assembly of the second double-acting pump.

66. The method of claim 65 further comprising:

directing a sixth portion of the pressurized power fluid from the source of the pressurized power fluid to the power chamber of the first double-acting pump via the first spool valve when the first spool valve is in the second position and the second spool valve is in the first position;

directing a seventh portion of the pressurized power fluid from the source of the pressurized power fluid to the first spool valve via the second spool valve when the first spool valve is in the second position and the second spool valve is in the second position, directing the seventh portion of the pressurized power fluid directed to the first spool valve to the power chamber of the first double-acting pump.

67. The method of claim 66 wherein the seventh portion of the pressurized power fluid directed to the power chamber of the first double-acting pump causes the piston assembly of the first double-acting pump to move so that the piston assembly of the first double-acting pump is on a power stroke when the first spool valve is in the second position and the second spool valve is in the second position.

68. The method of claim 67 further comprising directing an eighth portion of the pressurized power fluid from the source of the pressurized power fluid to the power chamber of the second double-acting pump via the second spool valve when the first spool valve is in the second position and the second spool valve is in the second position.

69. A method of controlling a pump, comprising:

providing a first double-acting pump comprising a power chamber and a piston assembly slidably disposed within the power chamber;

providing a second double-acting pump comprising a power chamber and a piston assembly slidably disposed within the power chamber;

positioning a first spool valve in a first position, the first spool valve having at least two positions;

positioning a second spool valve in a second position, the second spool valve having at least two positions;

directing a first portion of a pressurized power fluid from a source of the pressurized power fluid to the second spool valve;

wherein directing the first portion of the pressurized power fluid from the source of the pressurized power fluid to the second spool valve comprises: a first step of directing the first portion of the pressurized power fluid from the source of the pressurized power fluid to the first spool valve; and a second step of directing the first portion of the pressurized power fluid from the first spool valve to the second spool valve;

wherein the first portion of the pressurized power fluid does not pass through the source of the pressurized power fluid during the second step of directing the first portion of the pressurized power fluid from the first spool valve to the second spool valve; and directing the first portion of the pressurized power fluid directed to the second spool valve to the power chamber of the second double-acting pump;

wherein the first portion of the pressurized power fluid directed to the power chamber of the second double-acting pump causes the piston assembly of the second double-acting pump to move so that the piston assembly of the second double-acting pump is on a power stroke when the first spool valve is in the first position and the second spool valve is in the second position; and directing a second portion of the pressurized power fluid from the source of the pressurized power fluid to the power chamber of the first double-acting pump via the first spool valve.

70. The method of claim 69 further comprising directing a second portion of the pressurized power fluid from the source of the pressurized power fluid to the power chamber of the first double-acting pump via the first spool valve.

71. The method of claim 70 wherein the flow of the second portion of the pressurized power fluid directed to the power chamber of the first double-acting pump is restricted so that the piston assembly of the first double-acting pump is on a precompression stroke when the first spool valve is in the first position and the second spool valve is in the second position.

72. The method of claim 70 further comprising shifting the second spool valve to a first position at a predetermined point in a power stroke of the piston assembly of the second double-acting pump.

73. The method of claim 72 further comprising directing a third portion of the pressurized power fluid from the source of the pressurized power fluid to the first spool valve via the second spool valve when the first spool valve is in the first position and the second spool valve is in the first position.

74. The method of claim 73 further comprising directing the third portion of the pressurized power fluid directed to the first spool valve to the power chamber of the first double-acting pump.

75. The method of claim 74 wherein the third portion of the pressurized power fluid directed to the power chamber of the first double-acting pump causes the piston assembly of the first double-acting pump to move so that the piston assembly of the first double-acting pump is on a power stroke when the first spool valve is in the first position and the second spool valve is in the first position.

76. The method of claim 75 further comprising directing a fourth portion of the pressurized power fluid from the source of the pressurized power fluid to the power chamber of the second double-acting pump via the second spool valve when the first spool valve is in the first position and the second spool valve is in the first position.

77. The method of claim 76 wherein the flow of the fourth portion of the pressurized power fluid directed to the power chamber of the second double-acting pump is restricted so that the piston assembly of the second double-acting pump is on a precompression stroke when the first spool valve is in the first position and the second spool valve is in the first position.

78. The method of claim 75 further comprising shifting the first spool valve to a second position at a predetermined point in the power stroke of the piston assembly of the first double-acting pump.

79. The method of claim 78 further comprising:

directing a fifth portion of the pressurized power fluid from the source of the pressurized power fluid to the second spool valve via the first spool valve when the first spool valve is in the second position and the second spool valve is in the first position; and directing the fifth portion of the pressurized power fluid directed to the second spool valve to the power chamber of the second double-acting pump.

80. The method of claim 79 wherein the fifth portion of the pressurized power fluid directed to the power chamber of the second double-acting pump causes the piston assembly of the second double-acting pump to move so that the piston assembly of the second double-acting pump is on a power stroke when the first spool valve is in the second position and the second spool valve is in the first position.

81. The method of claim 80 further comprising directing a sixth portion of the pressurized power fluid to fluid from the source of the pressurized power fluid to the power chamber of the first double-acting pump via the first spool valve when the first spool valve is in the second position and the second spool valve is in the first position.

82. The method of claim 80 further comprising shifting the second spool valve to the second position at a predetermined point in the power stroke of the piston assembly of the second double-acting pump.

83. The method of claim 82 further comprising:

directing a seventh portion of the pressurized power fluid from the source of the pressurized power fluid to the first spool valve via the second spool valve when the first spool valve is in the second position and the second spool valve is in the second position;

directing the seventh portion of the pressurized power fluid directed to the first spool valve to the power chamber of the first double-acting pump.

84. The method of claim 83 wherein the seventh portion of the pressurized power fluid directed to the power chamber of the first double-acting pump causes the piston assembly of the first double-acting pump to move so that the piston assembly of the first double-acting pump is on a power stroke when the first spool valve is in the second position and the second spool valve is in the second position.

85. The method of claim 84 further comprising directing an eighth portion of the pressurized power fluid from the source of the pressurized power fluid to the power chamber of the second double-acting pump via the second spool valve when the first spool valve is in the second position and the second spool valve is in the second position.

86. A method of controlling a pump, comprising:

providing a double acting duplex pump comprising a first double-acting pump comprising a power chamber and a piston assembly slidably disposed within the power chamber; and a second double-acting pump operably connected to the first double-acting pump, wherein the second double-acting pump comprises a power chamber and a piston assembly slidably disposed within the power chamber;

providing a fluid control system comprising a first spool valve having at least two positions; and a second spool valve having at least two positions;

positioning the first spool valve in a first position;

positioning the second spool valve in a second position;

directing a pressurized power fluid to the double-acting duplex pump via the fluid control system, wherein directing the pressurized power fluid to the double-acting duplex pump via the fluid control system comprises:

a first step of directing a first portion of the pressurized power fluid from a source of the pressurized power fluid to the first spool valve;

a second step of directing the first portion of the pressurized power fluid from the first spool valve to the second spool valve; and a third step of directing the first portion of the pressurized power fluid from the second spool valve to a power chamber of the second double-acting pump;

wherein the first portion of the pressurized power fluid directed to the power chamber of the second double-acting pump causes the piston assembly of the second double-acting pump to move so that the piston assembly of the second double-acting pump is on a power stroke when the first spool valve is in the first position and the second spool valve is in the second position; and wherein a second portion of the pressurized power fluid is directed from the source of the pressurized power fluid to the power chamber of the first double-acting pump via the first spool valve.

87. A method of controlling a pump, comprising:

providing a double acting duplex pump comprising a first double-acting pump comprising a power chamber and a piston assembly slidably disposed within the power chamber; and a second double-acting pump operably connected to the first double-acting pump, wherein the second double-acting pump comprises a power chamber and a piston assembly slidably disposed within the power chamber;

providing a fluid control system comprising a first spool valve having at least two positions; and a second spool valve having at least two positions;

positioning the first spool valve in a first position;

positioning the second spool valve in a second position;

directing a pressurized power fluid to the double-acting duplex pump via the fluid control system, wherein a first portion of the pressurized power fluid is directed from a source of the pressurized power fluid to a power chamber of the second double-acting pump via the second spool valve and the first spool valve, wherein the first portion of the pressurized power fluid flows from the source of the pressurized power fluid to the first spool valve;

wherein the first portion of the pressurized power fluid flows from the first spool valve to the second spool valve, and wherein the first portion of the pressurized power fluid does not flow through the source of the pressurized power fluid on its way from the first spool valve to the second spool valve wherein the first portion of the pressurized power fluid flows from the second spool valve to a power chamber of the second double-acting pump wherein the first portion of the pressurized power fluid directed to the power chamber of the second double-acting pump causes the piston assembly of the second double-acting pump to move so that the piston assembly of the second double-acting pump is on a power stroke when the first spool valve is in the first position and the second spool valve is in the second position; and wherein a second portion of the pressurized power fluid is directed from the source of the pressurized power fluid to the power chamber of the first double-acting pump via the first spool valve.

* * * * *